US008453275B2

(12) United States Patent
May et al.

(10) Patent No.: US 8,453,275 B2
(45) Date of Patent: Jun. 4, 2013

(54) COMBINATION BATHTUB AND SPA

(75) Inventors: Thomas May, Chattanooga, TN (US); Lody Chandra, Las Vegas, NV (US); George T. Hendricks, Miramar Beach, FL (US)

(73) Assignee: May Manufacturing LLC, Chattanooga, TN (US)

( * ) Notice: Subject to any disclaimer, the term of this patent is extended or adjusted under 35 U.S.C. 154(b) by 384 days.

(21) Appl. No.: 12/380,917

(22) Filed: Mar. 5, 2009

(65) Prior Publication Data

US 2010/0223721 A1 Sep. 9, 2010

(51) Int. Cl.
*A47K 3/00* (2006.01)

(52) U.S. Cl.
USPC ..... 4/541.1; 4/541.6; 4/545; 4/580; 4/507

(58) Field of Classification Search
USPC ..... 4/498, 507, 509, 541.1–541.6, 557, 4/559, 571.1, 580, 492, 493, 545
See application file for complete search history.

(56) References Cited

U.S. PATENT DOCUMENTS

| | | | | |
|---|---|---|---|---|
| 3,297,025 | A | 1/1967 | Jacuzzi | |
| 3,786,921 | A * | 1/1974 | Johnson | 210/130 |
| 3,906,928 | A * | 9/1975 | Wright | 126/563 |
| 4,233,694 | A | 11/1980 | Janosko et al. | |
| 4,330,412 | A * | 5/1982 | Frederick | 210/805 |
| 4,339,833 | A * | 7/1982 | Mandell | 4/541.6 |
| 4,340,039 | A * | 7/1982 | Hibbard et al. | 601/157 |
| 4,349,434 | A * | 9/1982 | Jaworski | 210/94 |
| 4,379,438 | A * | 4/1983 | Peardon | 119/702 |
| 4,530,120 | A * | 7/1985 | Etani | 4/541.3 |
| 4,716,605 | A * | 1/1988 | Shepherd et al. | 4/541.2 |
| 4,761,838 | A | 8/1988 | Hargrove | |
| 4,853,987 | A * | 8/1989 | Jaworski | 4/541.6 |
| 4,856,125 | A | 8/1989 | Dijkhuizen | |

(Continued)

FOREIGN PATENT DOCUMENTS

| | | | |
|---|---|---|---|
| EP | 338607 | A1 * | 10/1989 |
| EP | 0458779 | A1 | 11/1991 |
| EP | 1 54 578 | | 10/2003 |

OTHER PUBLICATIONS

Web page advertising bathtub.

*Primary Examiner* — Joshua J Michener
*Assistant Examiner* — Babajide Demuren
(74) *Attorney, Agent, or Firm* — Chambliss, Bahner & Stophel, P.C.

(57) ABSTRACT

A combination bathtub and spa includes a tub enclosure that is adapted to contain a quantity of water, a drain having a drain valve that may be opened to drain water from the tub enclosure or closed to retain water therein, a supply system for supplying water to the tub enclosure, and a lid that is adapted to removably cover the tub enclosure. The combination bathtub and spa also includes a pump having an inlet and an outlet, a suction line that provides a path for water from the tub enclosure to the inlet of the pump, a jet nozzle that is located in the sidewall of the tub enclosure, and a jet nozzle supply line that provides a path for water from the outlet of the pump to the jet nozzle. A filter is provided to filter the water that flows into the tub enclosure, as well as a heater for heating the water that flows into the tub enclosure. A control valve is adapted to open to allow water to flow through the filter or to close to stop the flow of water through the filter.

9 Claims, 19 Drawing Sheets

U.S. PATENT DOCUMENTS 4,861,231 A * 8/1989 Howard ..... 417/38
4,924,069 A 5/1990 Giordani
5,032,292 A * 7/1991 Conrad ..... 210/764
5,079,784 A * 1/1992 Rist et al. ..... 4/541.2
5,101,521 A * 4/1992 Levien ..... 4/559
5,236,581 A * 8/1993 Perry ..... 210/130
5,245,714 A 9/1993 Haraga et al.
5,335,376 A 8/1994 Kaldewei
5,441,529 A 8/1995 Dorsch
5,526,538 A 6/1996 Rainwater
5,548,852 A * 8/1996 Rowe ..... 4/509
6,003,166 A * 12/1999 Hald et al. ..... 4/541.1
6,243,889 B1 * 6/2001 Ducharme et al. ..... 4/545
6,279,177 B1 8/2001 Gloodt
6,355,913 B1 * 3/2002 Authier et al. ..... 219/481
6,357,060 B2 3/2002 Gloodt
6,395,167 B1 5/2002 Mattson, Jr. et al.
6,681,414 B1 1/2004 May et al.
6,760,931 B1 7/2004 Mattson, Jr. et al.
7,060,180 B1 * 6/2006 Barnes ..... 210/167.11
7,146,659 B2 12/2006 Mattson, Jr. et al.
2002/0069460 A1 6/2002 Huffington et al.
2002/0129444 A1 * 9/2002 Horwood et al. ..... 4/541.1
2002/0148038 A1 * 10/2002 Gardenier et al. ..... 4/575.1
2003/0213059 A1 * 11/2003 Mattson et al. ..... 4/541.1
2004/0148693 A1 * 8/2004 Anderson ..... 4/541.1
2004/0221381 A1 * 11/2004 Mattson et al. ..... 4/541.1
2005/0005349 A1 * 1/2005 Gardenier ..... 4/541.1
2005/0172392 A1 8/2005 Swart et al.
2005/0210575 A1 * 9/2005 Erb ..... 4/541.1
2005/0235409 A1 * 10/2005 Sisk ..... 4/541.1
2006/0137087 A1 * 6/2006 Carreau et al. ..... 4/541.1
2006/0230513 A1 * 10/2006 Cunerty ..... 4/498
2006/0236450 A1 * 10/2006 Shanks ..... 4/580
2006/0288476 A1 * 12/2006 Reynolds, II ..... 4/541.1
2007/0094784 A1 * 5/2007 Tran ..... 4/541.5
2008/0168599 A1 * 7/2008 Caudill et al. ..... 4/541.1

* cited by examiner

COMBINATION BATHTUB AND SPA

FIELD OF THE INVENTION

The present invention relates generally to spas, and more particularly to a tub assembly that can be used as either a jetted bathtub or a recirculating spa.

BACKGROUND OF THE INVENTION

Bathtubs have been known and used for centuries. Modern bathtubs may comprise a molded shell which forms a tub enclosure having a floor and an upstanding sidewall. The shell is typically constructed of fiberglass, plastic or a similar material, or a composite of such materials. Modern bathtubs are also provided with hot and cold water valves and supply lines which are attached to a supply nozzle or nozzles. In addition, a modern bathtub will include a drain having a drain valve that may be opened to remove water from the tub enclosure. A jetted bathtub is similar to a standard bathtub, but typically includes a pump and associated plumbing which is adapted to discharge water, usually mixed with air, into the enclosure through a plurality of jet nozzles that are mounted in the sidewall of the tub enclosure.

A jetted bathtub assembly is described in U.S. Pat. No. 3,297,025. This tub assembly includes a conventional water supply including a mixing faucet and a pair of water supply lines with associated valves, and a conventional tub drain and valve and an overflow drain. The tub assembly also includes a hydrotherapy system comprising a plurality of jet nozzles which are adapted to inject a mixture of air and water into the tub enclosure. A water manifold extends around the outside of the tub enclosure and is in fluid communication with each of the jet nozzles, and a water inlet conduit extends through the wall of the tub enclosure. A pump has an inlet side to which the inlet conduit is attached and a discharge side to which the water manifold is attached. Air is provided to the jet nozzles through an air manifold which utilizes as an intake port the overflow drain conduit of the tub assembly. When water is contained in the tub enclosure, the pump can be activated to draw water from the enclosure through the inlet conduit to the pump and to discharge water through the jet nozzles into the enclosure. Air under atmospheric pressure is drawn into the air manifold by a low pressure area created within the jet nozzles when water is pumped therethrough, so that air is mixed with the water passing through the jet nozzles.

U.S. Pat. No. 6,279,177 describes a jetted bathtub which includes a water purging system to supply air pressure to the jetted circulation system of the tub to purge any standing water remaining in the system when the pump is not operating. The purging system includes an air pump and an air manifold which is connected to one or more components of the jetted circulation system. The purging system also includes a controller and a heater which is adapted to substantially heat the air flowing through the air pump and the air manifold so that warm, dry air may be provided to the jetted circulation system. If the tub is full of water when the purging system is operated, actuation of the air pump will cause pressurized air to aerate the water flowing through the jet nozzles; however, if the tub is empty, actuation of the air pump will cause air to flow through the jetted circulation system, thereby forcing substantially all of the water remaining in the system out through the jet nozzles.

U.S. Pat. No. 6,357,060 describes a jetted bathtub similar to that of U.S. Pat. No. 6,279,177, except that it includes an ozone generator that is pneumatically connected to the air pump of the water purging system. The improved purging system of this patent is adapted to provide warm, dry, ozone-treated air to the jetted circulation system.

U.S. Pat. No. 6,395,167 describes a jetted bathtub having a combination suction fixture and disposable filter assembly. The circulation system for this tub is conventional, except that the suction fixture includes a perforated faceplate which is attached to a filter housing. The filter housing is adapted to receive a disposable filter for filtering material from the water passing through the circulation system.

Bathing appliances in the nature of spas have also become commercially successful in recent years. These spas are typically constructed as a molded shell to form a water containment or tub enclosure having a footwell or floor and an upstanding sidewall. Molded within the enclosure are a plurality of therapy stations which may include seats or platforms for reclining. The shell is typically constructed of fiberglass, plastic or a similar material, or a composite of such materials. One or more pumps are usually placed under the shell to draw water from the enclosure and discharge it, usually with air, into the enclosure through a plurality of nozzles or jets of various types. The jets are usually mounted through the shell in the sidewall, and they are designed to provide a comforting or therapeutic effect to a person occupying a therapy station. Water lines are provided between the various jets, pumps and water inlet ports, and are usually comprised of PVC piping and flexible tubing. Filters and heaters may also be provided in the typical spa.

U.S. Pat. No. 5,526,538 describes a spa having both a low speed pump and a high speed pump, and a separate circulation system associated with each pump. The low speed pump continuously circulates water from the tub enclosure through a heater and back into the tub enclosure, while the high speed pump may be operated intermittently to discharge water drawn from the tub enclosure through the spa's jet nozzles. A one-way check valve keeps water from being drawn into the circulation system through jet nozzles mounted in the walls of the tub enclosure during operation of the low speed pump. However, when a user desires to employ the jet nozzles, the high speed pump can be activated to draw water out of the tub through a skimmer and suction fitting, and to discharge the water through the one-way check valve and back into the tub through the jet nozzles.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

The use of any and all examples or exemplary language (e.g., "such as") herein is intended merely to better illuminate the invention and does not pose a limitation on the scope of the invention unless otherwise claimed. Nothing in the specification should be construed as indicating any non-claimed element as essential to the practice of the invention.

Various terms are specifically defined herein. These terms are to be given their broadest possible construction consistent with such definitions, as follows:

As used herein, the terms "jet", "jet nozzle" and "nozzle" refer to an orifice or nozzle through which water or water mixed with air may be pumped, discharged or dispensed.

As used herein, the term "bathtub" refers to a bathing appliance having a fluid enclosure that is adapted to contain a quantity of water, means for supplying water to the fluid enclosure and a drain for emptying the fluid enclosure of water. A "jetted bathtub" is a bathtub that includes one or more jets which are adapted to dispense water and/or a mixture of water and air into the fluid enclosure in order to produce a therapeutic effect. A "bathtub" is typically employed to hold a quantity of water for a single use and to drain the water from the fluid enclosure after each use.

As used herein, the term "spa" refers to an appliance having a fluid enclosure that is adapted to contain a quantity of water and which includes at least one jet which is adapted to dispense water and/or a mixture of water and air into the fluid enclosure to produce a therapeutic effect. A "spa" typically includes a recirculation system by which water in the enclosure is recirculated, filtered and heated during use. A spa is typically employed to hold a quantity of water for use on multiple occasions. Consequently, a spa will usually include a removable cover that may be placed over the fluid enclosure to keep the water clean and to retain heat therein.

SUMMARY OF THE INVENTION

The invention comprises a combination bathtub and spa which may be operated as a spa, as a conventional bathtub or as a jetted bathtub. The combination includes a tub enclosure that is adapted to contain a quantity of water, a drain having a drain valve that may be opened to drain water from the tub enclosure or closed to retain water therein, means for supplying water to the tub enclosure and a lid that is adapted to removably cover the tub enclosure. The combination also includes a pump having an inlet and an outlet, and at least one jet nozzle that is located in the sidewall of the tub enclosure. A suction line provides a path for water from the tub enclosure to the inlet of the pump, and a discharge line provides a path for water from the outlet of the pump to the jet nozzle. A filter is provided to filter the water that flows into the tub enclosure, and a heater is provided for heating the water that flows into the tub enclosure. A control valve may be opened to allow water to flow through the filter or closed to stop the flow of water through the filter.

In order to facilitate an understanding of the invention, the preferred embodiments of the invention, as well as the best mode known by the inventors for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter recited in the claims, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which.

DESCRIPTION OF THE PREFERRED EMBODIMENTS OF THE INVENTION

Figure 5:
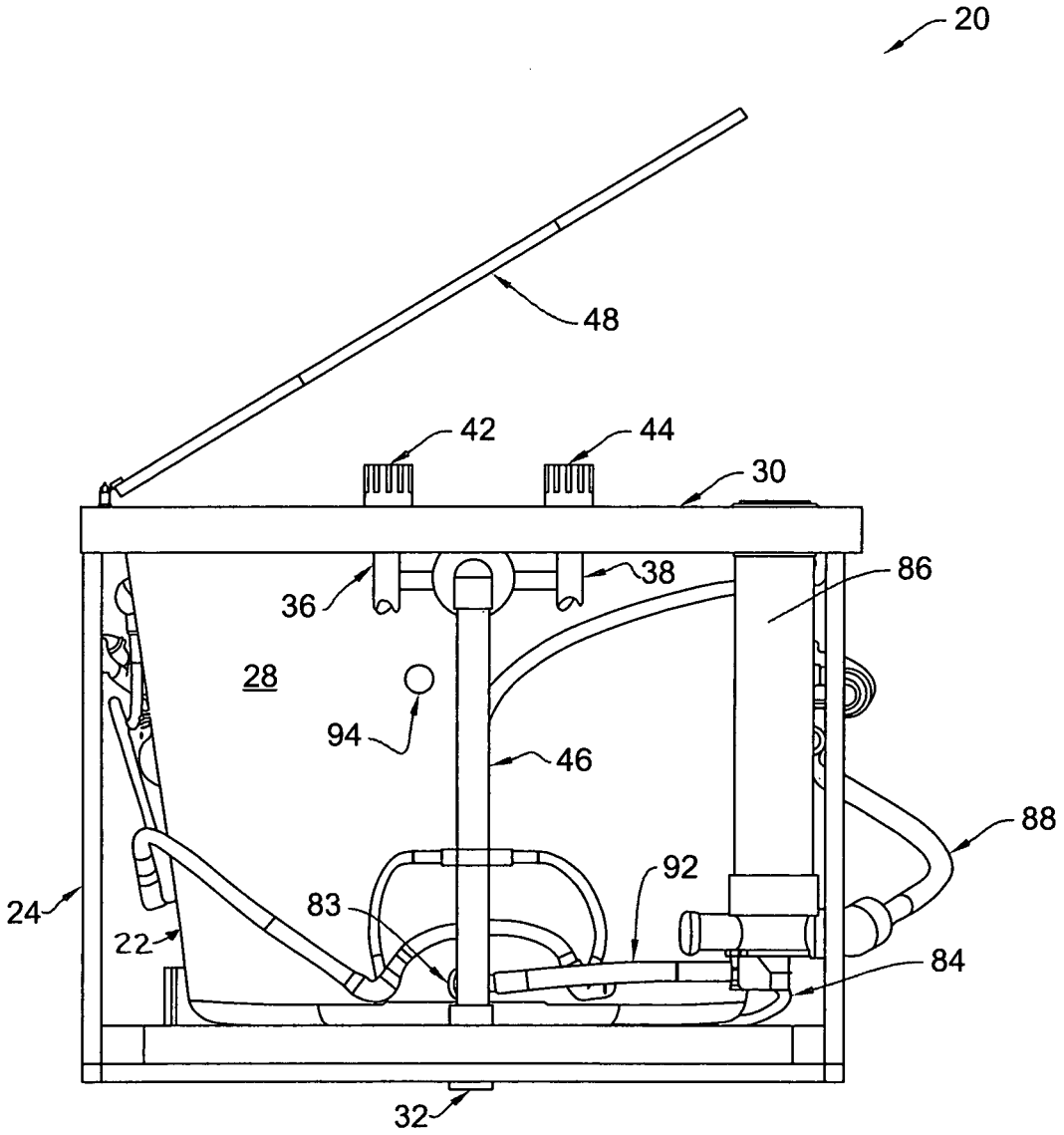
FIG. 5 is a left side view of the embodiment of the invention illustrated in FIGS. 1-4.

Referring now to FIGS. 1-6, a first embodiment 20 of the invention is illustrated. This combination bathtub and spa comprises tub enclosure 22 that is adapted to contain a quantity of water and is supported by frame 24 and base 25. Tub enclosure 22 comprises tub floor 26 (best shown in FIG. 1) and upstanding sidewall 28 which is integrally attached to and surrounds the floor. Combination 20 also includes supporting rim 30, which is disposed around at least a portion of sidewall 28, and drain 32. Preferably, the supporting rim is integrally attached to the upstanding sidewall. Drain 32 includes a conventional drain valve (not shown) that may be opened to drain water from the tub enclosure, or closed to retain water therein. Water is supplied to the tub enclosure by means of cold water supply line 36 and hot water supply line 38 (both of which are shown in FIG. 5), and the flow of water is directed through the faucet portion of combination faucet/overflow drain fixture 40 by cold water valve 42 and hot water valve 44. Each of valves 42 and 44 is connected to its associated supply line and is operable by a user to open to allow the flow of water through the supply line, or to close to stop the flow of water through the supply line. Combination 20 also includes overflow drain pipe 46 (best shown in FIG. 5) that connects the overflow inlet of combination faucet/overflow drain fixture 40 and drain 32. Combination 20 also includes tub enclosure lid 48, which is hinged to supporting rim 30 along one side. In the alternative (not shown), a removable tub enclosure lid may be provided.

Combination bathtub and spa 20 is an embodiment of the invention which utilizes a single pump. Thus, as shown in FIGS. 1-4 and 6, combination 20 includes pump 50 which is mounted for convenience on pedestal 52. Pump 50 includes inlet 54 and outlet 56 (best shown in FIGS. 2 and 3). Suction line 58 extends through the sidewall of tub enclosure 22 to provide a path for water from the tub enclosure to the inlet of the pump. Pump 50 is adapted to selectively operate at a low flow rate and at a high flow rate, as will be described in more detail hereinafter.

Heater 60 (best shown in FIGS. 2, 3 and 6), having first end 62 and second end 64, is mounted to outlet 56 of pump 50. Combination 20 also includes a plurality of jet nozzles 66 mounted in the sidewall of the tub enclosure (see FIG. 1). Each jet nozzle is connected by one or more jet nozzle supply lines 68 to water manifold 70 (see FIGS. 2 and 6), and water manifold 70 is connected to a first control valve such as pressure-sensitive bypass valve 72 (best shown in FIG. 6). Preferably, bypass valve 72 is spring-loaded so that when the pump is operated at a low flow rate, the valve will remain closed, but when it is operated at a high flow rate, the valve will open. In the alternative, the first control valve may be a solenoid valve or other user-controllable valve known to those having ordinary skill in the art to which the invention relates. Valve 72 is connected by discharge line 73 to the second end of heater 60. Air control valve 74 is mounted near the top of the tub enclosure and operatively attached to air manifold 76 (shown in FIG. 4). This air control valve may be adapted to be operated manually by a user to admit air (when open) or to restrict the flow of air (when closed) through valve 74 and into air manifold 76, or it may be opened and closed by a switch. In either event, a plurality of air lines 78 are provided to connect the air manifold to each nozzle, so that by opening the air control valve, air may be mixed with water at each nozzle (in a manner known to those having ordinary skill in the art to which the invention relates) so that a mixture of air and water may be injected into the tub enclosure through each of the nozzles.

Figure 6:
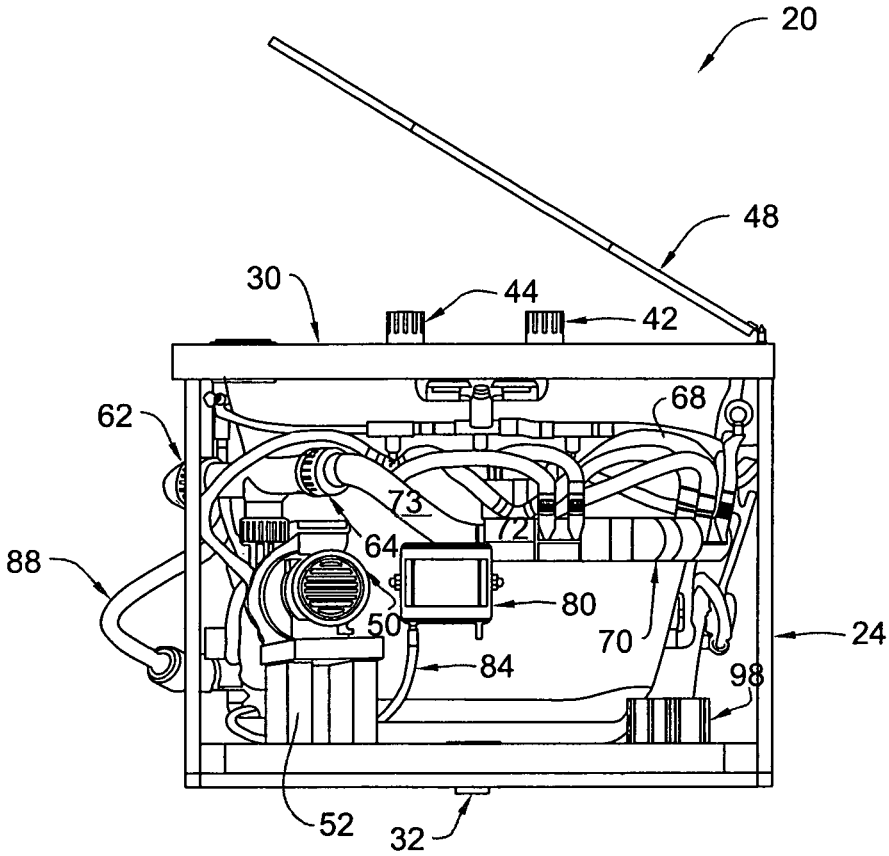
FIG. 6 is a right side view of the embodiment of the invention illustrated in FIGS. 1-5.

Combination 20 includes a sanitizer such as ozone generator 80, which is adapted to sanitize water flowing into the tub enclosure. As best shown in FIG. 6, ozone generator 80 is mounted on a second pedestal (not shown for clarity) and is adapted to generate ozone, which is then injected into jet nozzle 83 (best shown in FIG. 5) by ozone outlet line 84. Combination 20 also includes filter 86, which is connected to heater 60 and thereby to outlet 56 of pump 50 by filter inlet line 88 (best shown in FIG. 3). A second control valve such as solenoid valve 90 is mounted within filter inlet line 88 and is adapted to be opened to allow the flow of water through line 88 or closed to stop such flow. Filter outlet line 92 (best shown in FIG. 5) extends from the outlet of filter 86 to jet nozzle 83, thereby providing a path for filtered water from the filter to the tub enclosure.

A depth sensor 94 (shown schematically in FIG. 5) is mounted through the sidewall of the tub enclosure and adapted to sense when the depth of water in the tub enclosure is at least as high as, or is below, a predetermined level. Preferred controller 98, which is mounted in a convenient location on base 25 and operatively connected to the various operating components of combination 20, includes a software component that functions as an automatic switch to render the pump operative when the level of water in the tub enclosure is at or above the predetermined level, and inoperative when the level of water in the tub enclosure is below the predetermined level.

An operator's control panel 100 (see FIG. 1) is mounted in supporting rim 30 for easy access to a user, either from within or outside of the tub enclosure. Adjacent to control panel 100 is control switch 102, which may be operated by a user to switch between a bathtub mode and a spa mode. As will be described in more detail hereinafter, control panel 100 includes a heater switch that is operatively connected to the heater, which heater switch is operable by a user to adjust the temperature of the water flowing into the tub enclosure. As alluded to above, controller 98 is operatively connected (by means known to those having ordinary skill in the art to which the invention relates) to control switch 102 (shown in FIG. 1), control panel 100, heater 60, a water temperature sensor (not shown), pump 50, ozone generator 80, solenoid valve 90 and depth sensor 94. If air control valve 74 is adapted to be operated by a switch, the switch will also be connected to controller 98. Similarly, if the first control valve is user-controllable (rather than being an automatically actuated pressure-sensitive valve), it will also be operatively connected to controller 98.

A user may close drain 32 and manipulate valves 42 and 44 to allow the flow of water from the supply lines into the tub enclosure. In a preferred embodiment of combination 20, if depth sensor 94 indicates that there is water in the enclosure at or above the predetermined level, controller 98 will automatically set the control switch to the spa mode, will enable pump 50, heater 60 and ozone generator 80 to operate, and will open valve 90 to allow water to enter filter 86. In the spa mode, the controller will also cause the pump to operate at the low-flow rate, will cause the heater to operate at a low (or default) setting, and will cause the ozone generator to operate so that water in the enclosure remains heated, filtered and sanitized. A user may adjust the flow rate of pump 50 or the temperature of the water in the enclosure by employing control panel 100. Of course, the user may also reset control switch 102 to the bathtub mode, if desired.

When combination 20 is operated in the spa mode, the controller will open valve 90 so that water may enter filter 86 and will render pump 50 operable, as mentioned above. Pump 50 may then be operated by a user at either the low-flow rate or the high-flow rate, by setting the flow rate on control panel 100. With valve 90 remaining open, activating the pump at either the low-flow rate or the high-flow rate will cause water to flow out of discharge 56 of the pump, through heater 60 and filter inlet line 88 and into filter 86. Filtered water will then pass out of filter 86 through filter outlet line 92 and into the tub enclosure through jet nozzle 83. If the pump is operated at the low-flow rate, the pressure in discharge line 73 will not be high enough to open control valve 72, and water will not flow into water manifold 70. However, if pump 50 is operated at the high-flow rate (or if the filter is clogged while the pump is operating at the low-flow rate), even with valve 90 open, the pressure in discharge line 73 will be high enough to open valve 72, so that water may also flow into water manifold 70 (as well as through filter 86). The water may be heated as it passes through heater 60, as controlled by the user from control panel 100. From manifold 70, water will be passed through various jet nozzle supply lines 68 and into the tub enclosure through jet nozzles 66. A user may also open air control valve 74, manually or by means of control panel 100, causing air to be drawn through air manifold 76 and air lines 78 to be mixed with water at each nozzle so that a mixture of air and water may be injected into the tub enclosure through each of the nozzles.

If depth sensor 94 indicates that the water level in the enclosure is below the predetermined level, controller 98 will lock the control switch in the bathtub mode setting, will close valve 90, and will disable pump 50, heater 60 and ozone generator 80 from operation. Of course, if the depth sensor subsequently indicates that the water level in the enclosure is at or above the predetermined level, controller 98 will set the control switch to the spa mode.

Figure 1:
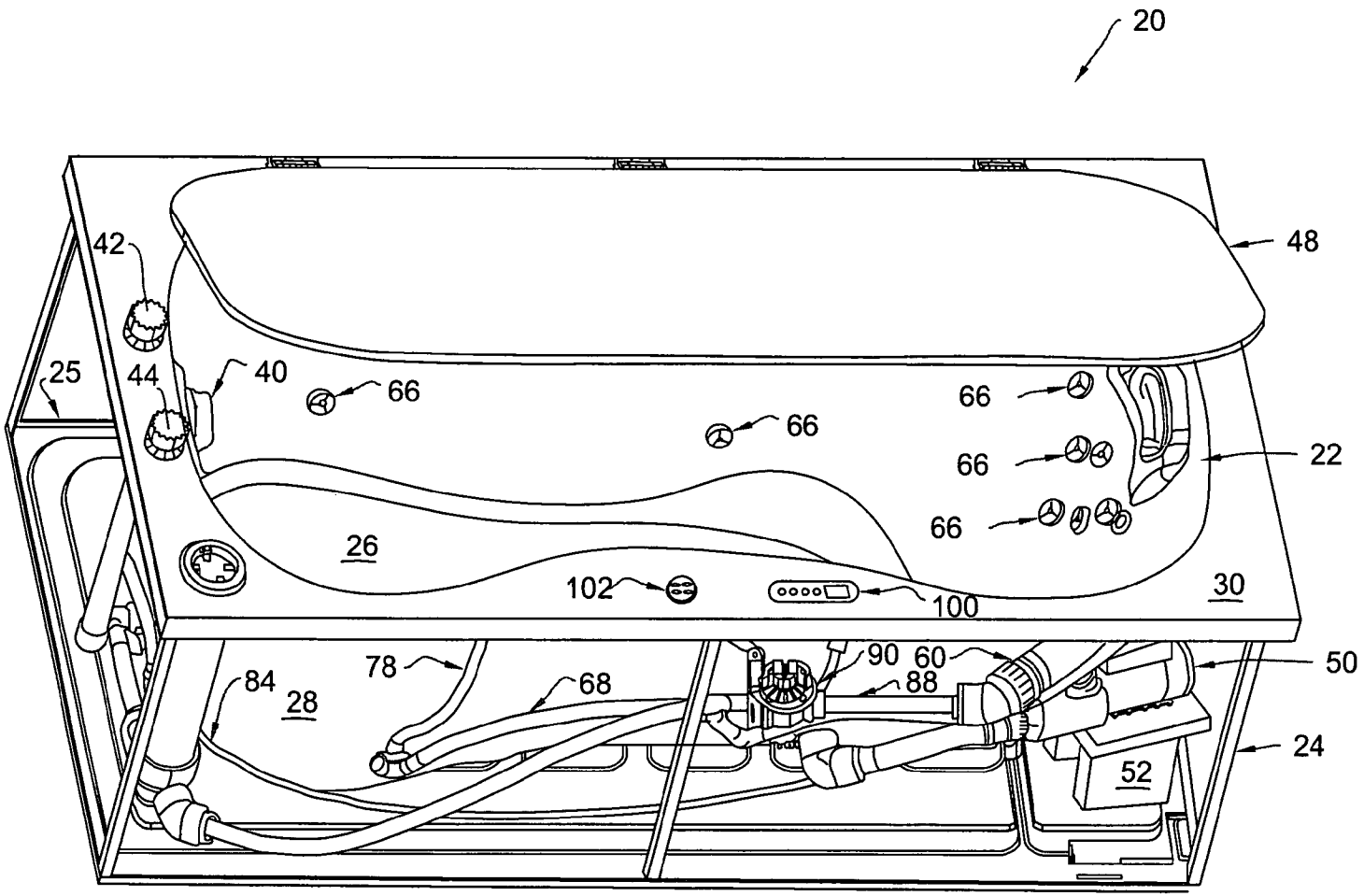
FIG. 1 is a top perspective view of a first embodiment of the invention, showing a combination bathtub and spa utilizing a single pump.
Figure 2:
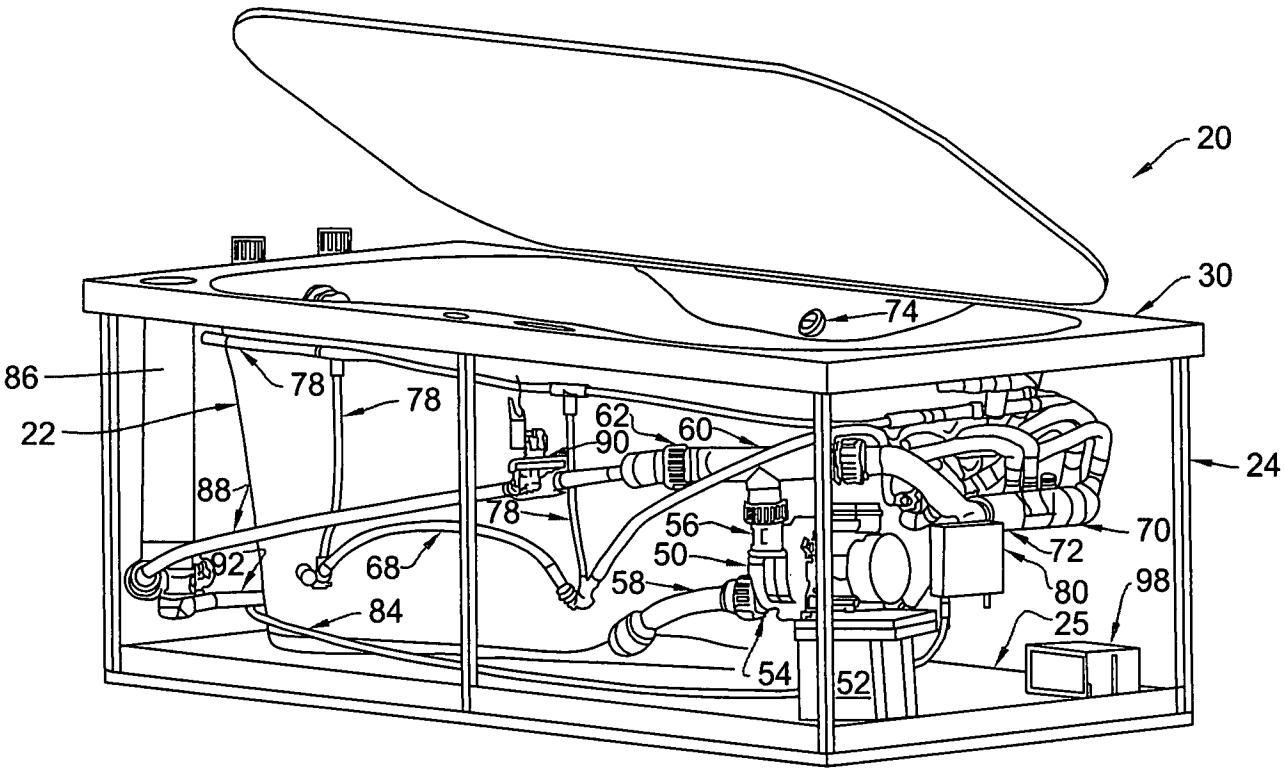
FIG. 2 is a side perspective view of the embodiment of the invention illustrated in FIG. 1.
Figure 3:
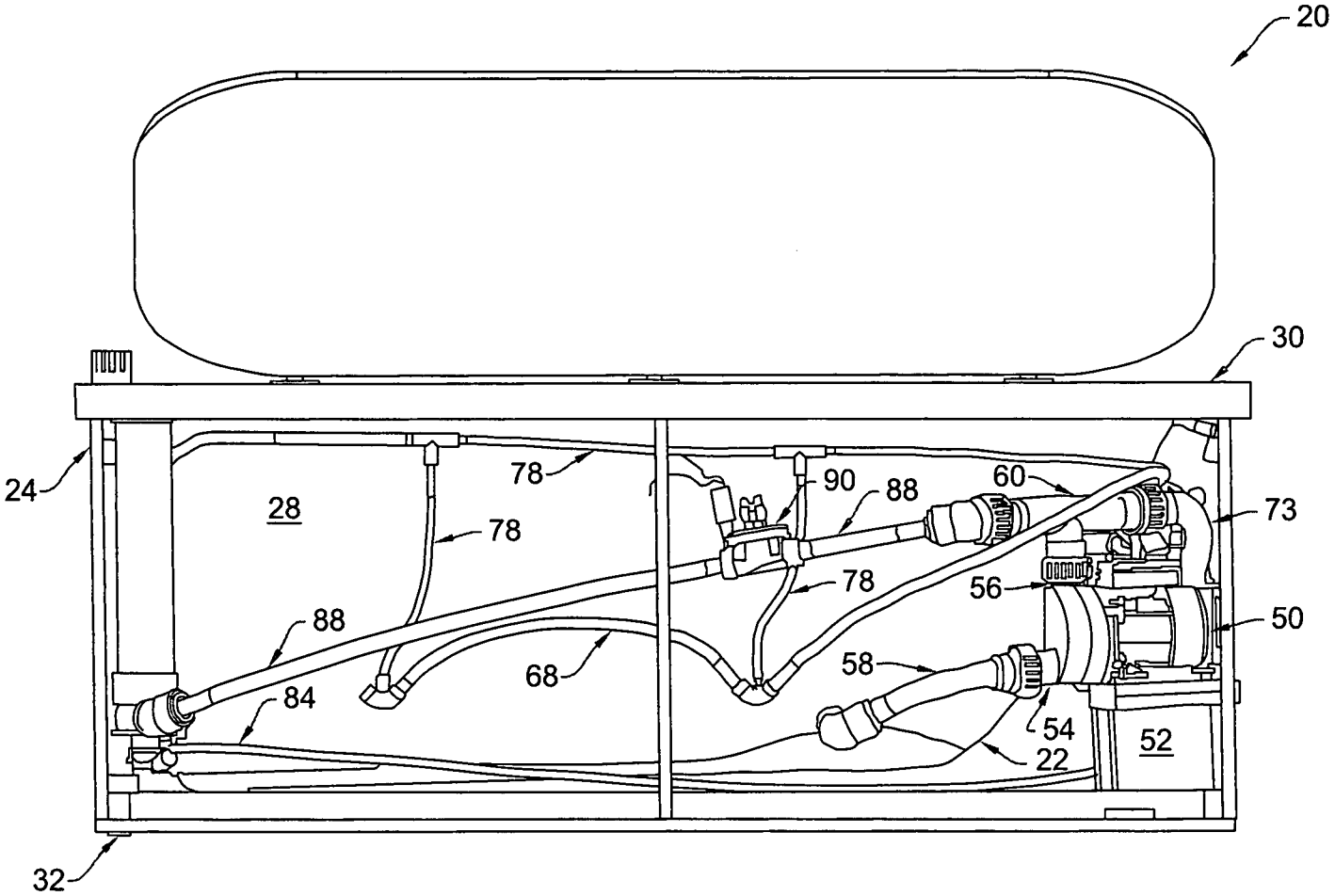
FIG. 3 is a front view of the embodiment of the invention illustrated in FIGS. 1 and 2.
Figure 4:
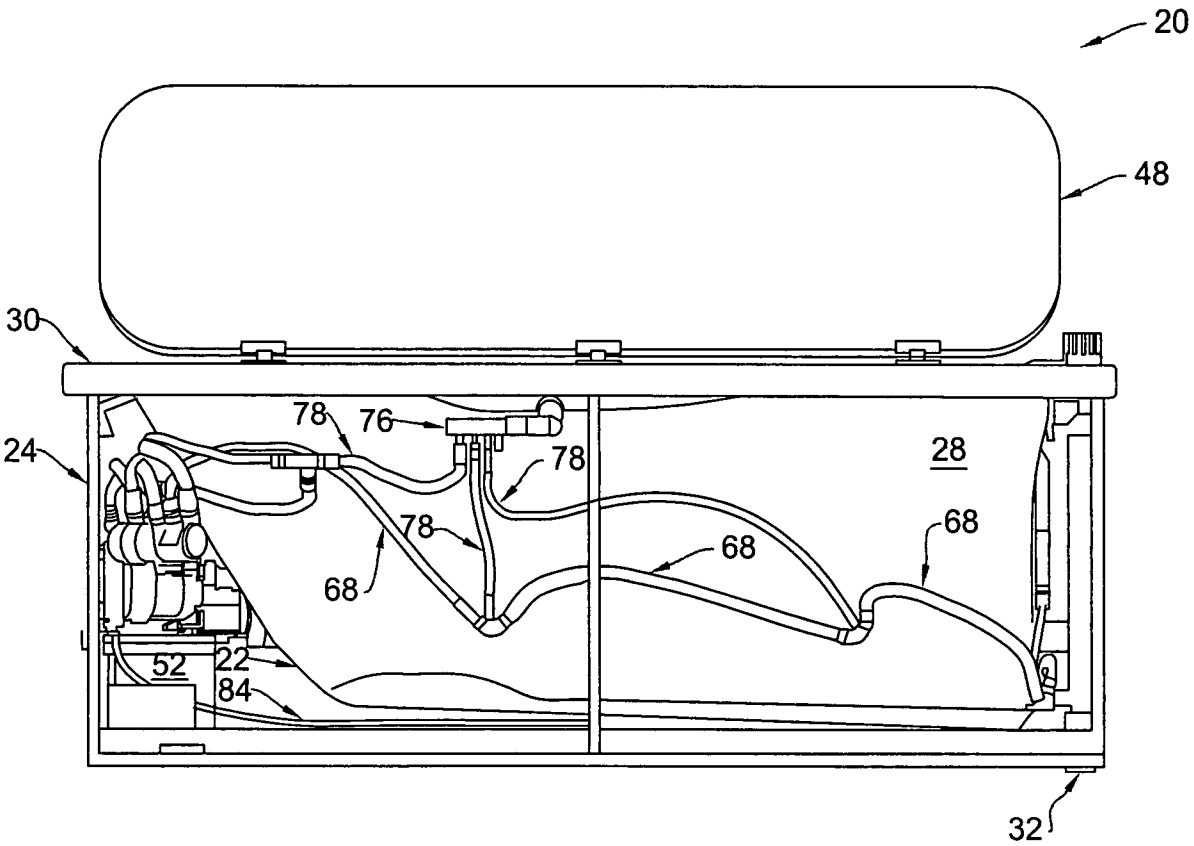
FIG. 4 is a rear view of the embodiment of the invention illustrated in FIGS. 1-3.

If a user sets the control switch to the bathtub mode, controller 98 will close valve 90 so that water may not enter filter 86. With valve 90 remaining closed (and the water level at or above the predetermined level at which controller will permit pump 50 to operate), activating the pump at either the low-flow rate or the high-flow rate will cause pressure to increase in the portion jet flow circuit comprising discharge line 73, heater 60 and the portion of filter inlet line 88 located upstream of valve 90 (i.e. to the right of valve 90 as shown in FIG. 3). This increase in pressure will cause valve 72 to open (or to remain open). Water will then flow out of discharge 56 of pump 50 into heater 60 and through discharge line 73, past valve 72 into water manifold 70. The water may be heated as it passes through heater 60, as controlled by the user from control panel 100. From manifold 70, water will be passed through various jet nozzle supply lines 68 and into the tub enclosure through jet nozzles 66. A user may also open air control valve 74, manually or by means of control panel 100, causing air to be drawn through air manifold 76 and air lines 78 to be mixed with water at each nozzle so that a mixture of air and water may be injected into the tub enclosure through each of the nozzles. When a user finishes bathing, drain valve 34 may be opened to drain the water from the tub enclosure.

Figure 7:
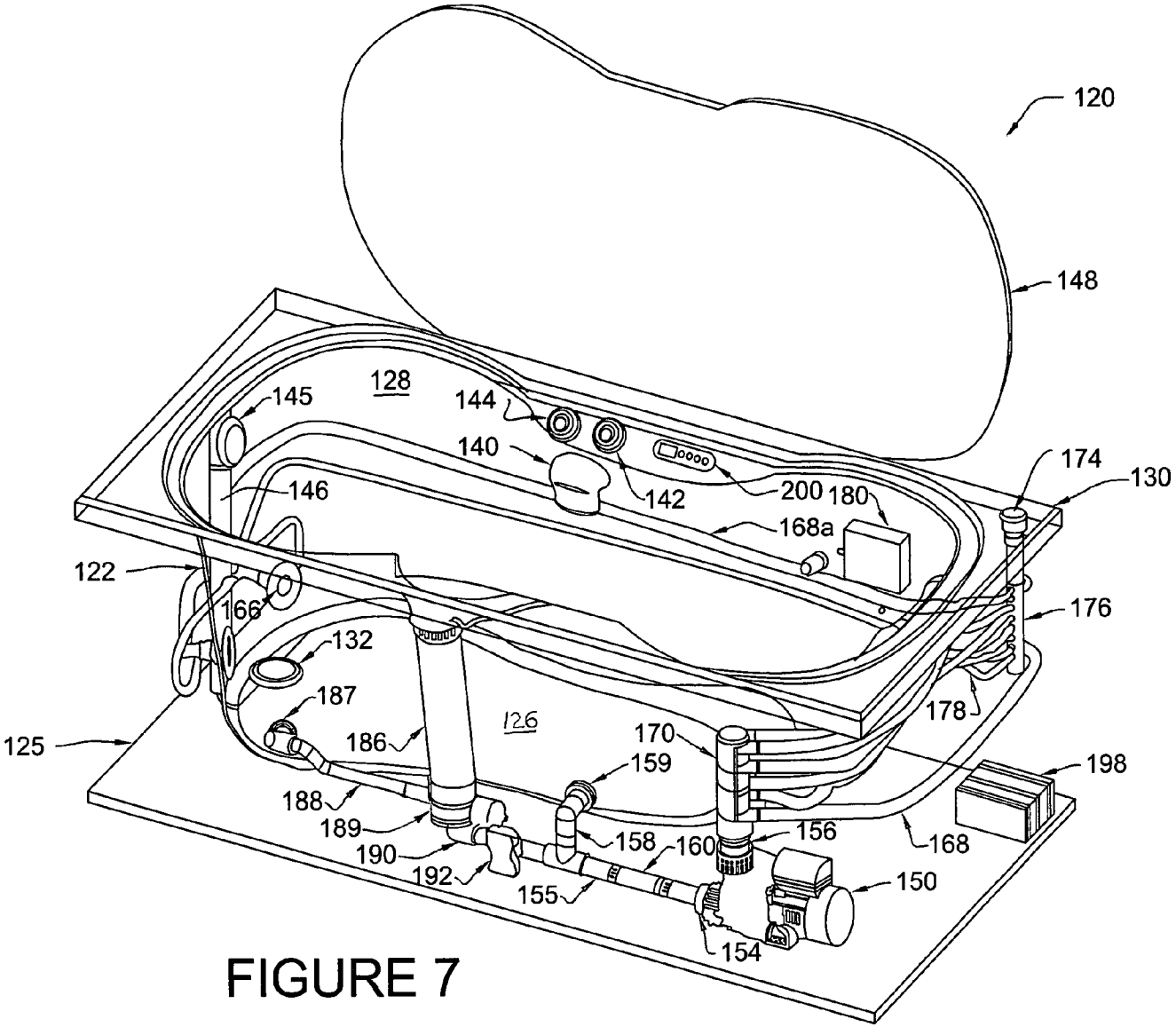
FIG. 7 is a top perspective view of a second embodiment of the invention, showing a combination bathtub and spa utilizing a single pump.
Figure 8:
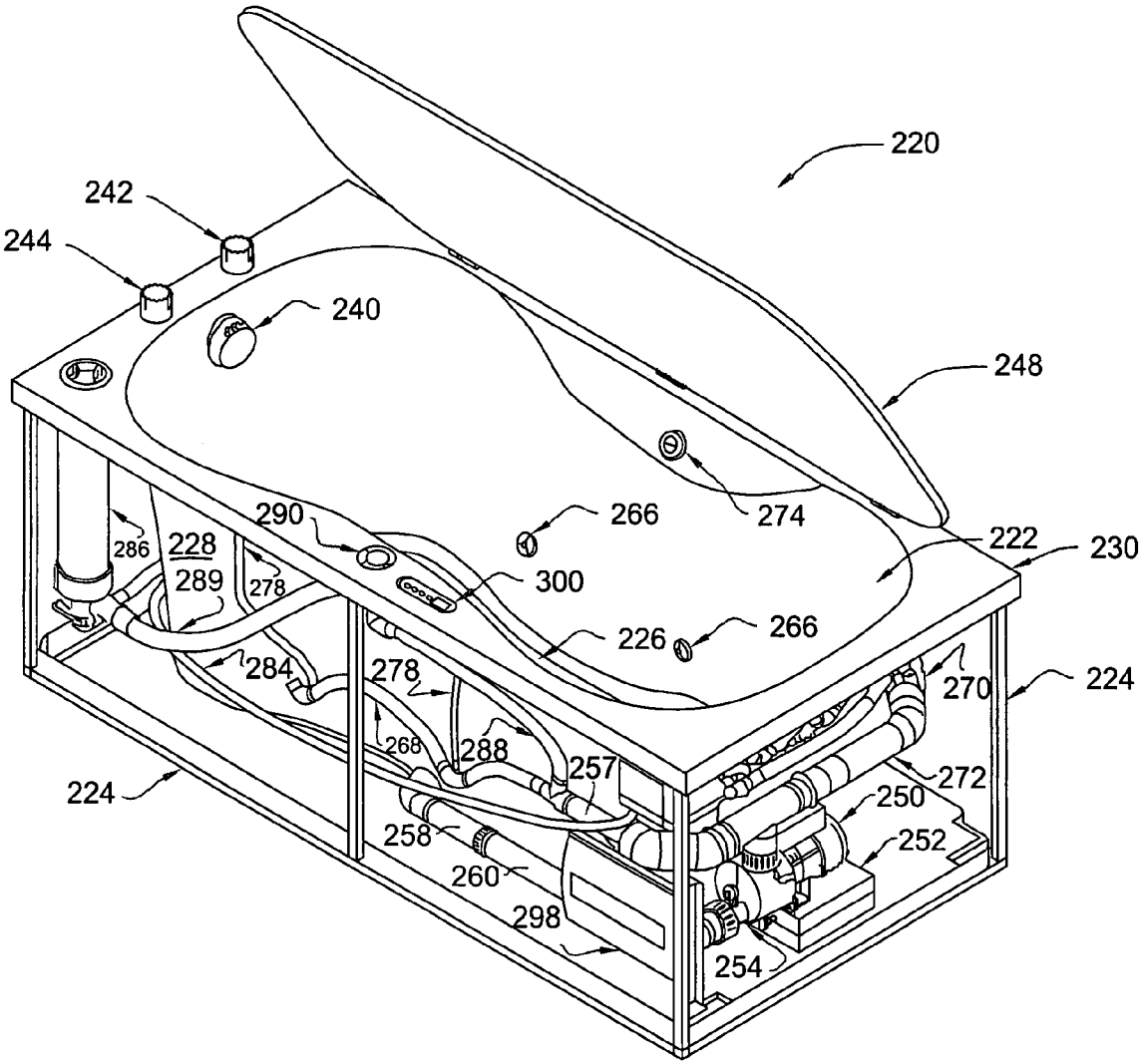
FIG. 8 is a top perspective view of a third embodiment of the invention, showing a combination bathtub and spa utilizing a single pump.
Figure 9:
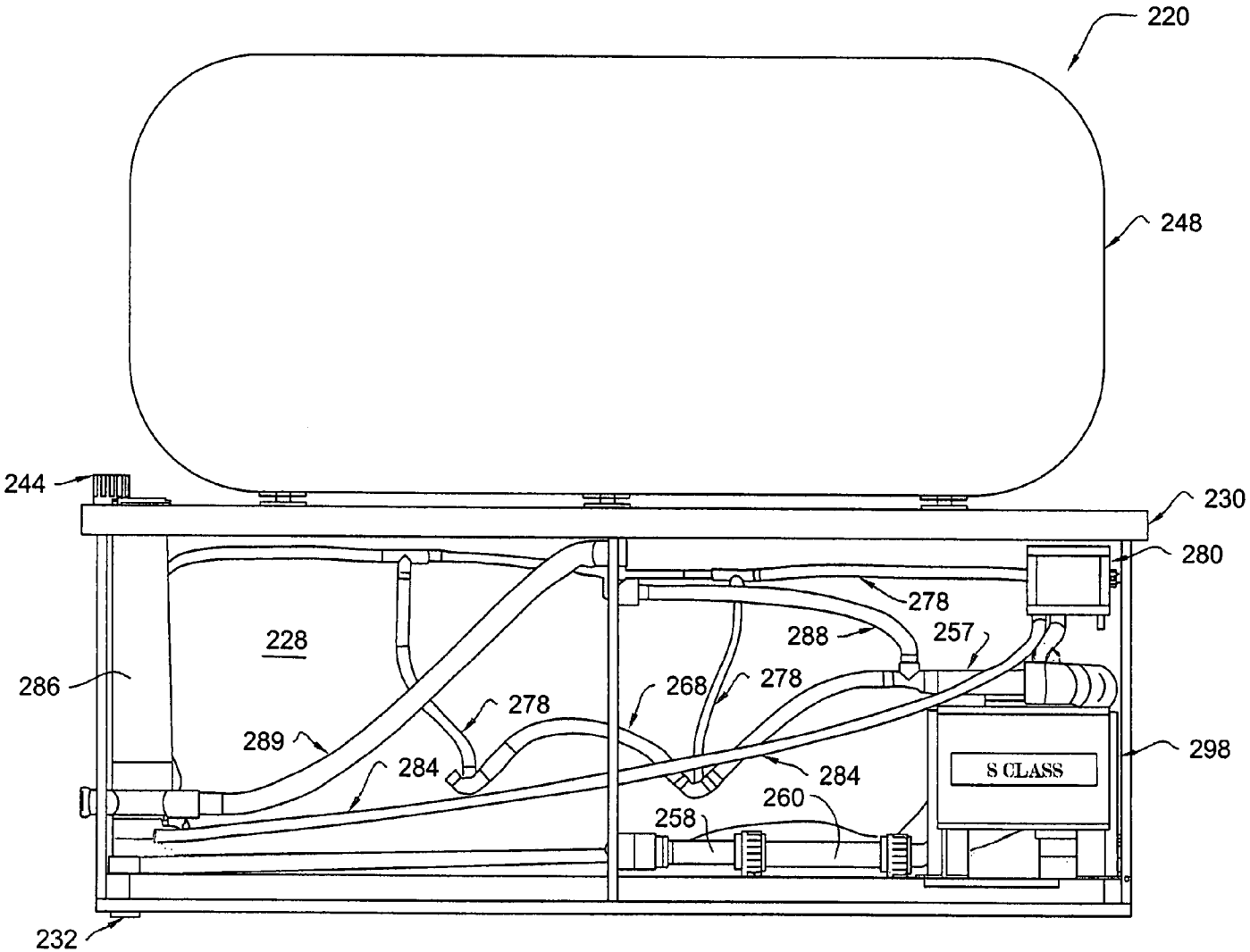
FIG. 9 is a front view of the embodiment of the invention illustrated in FIG. 8.
Figure 10:
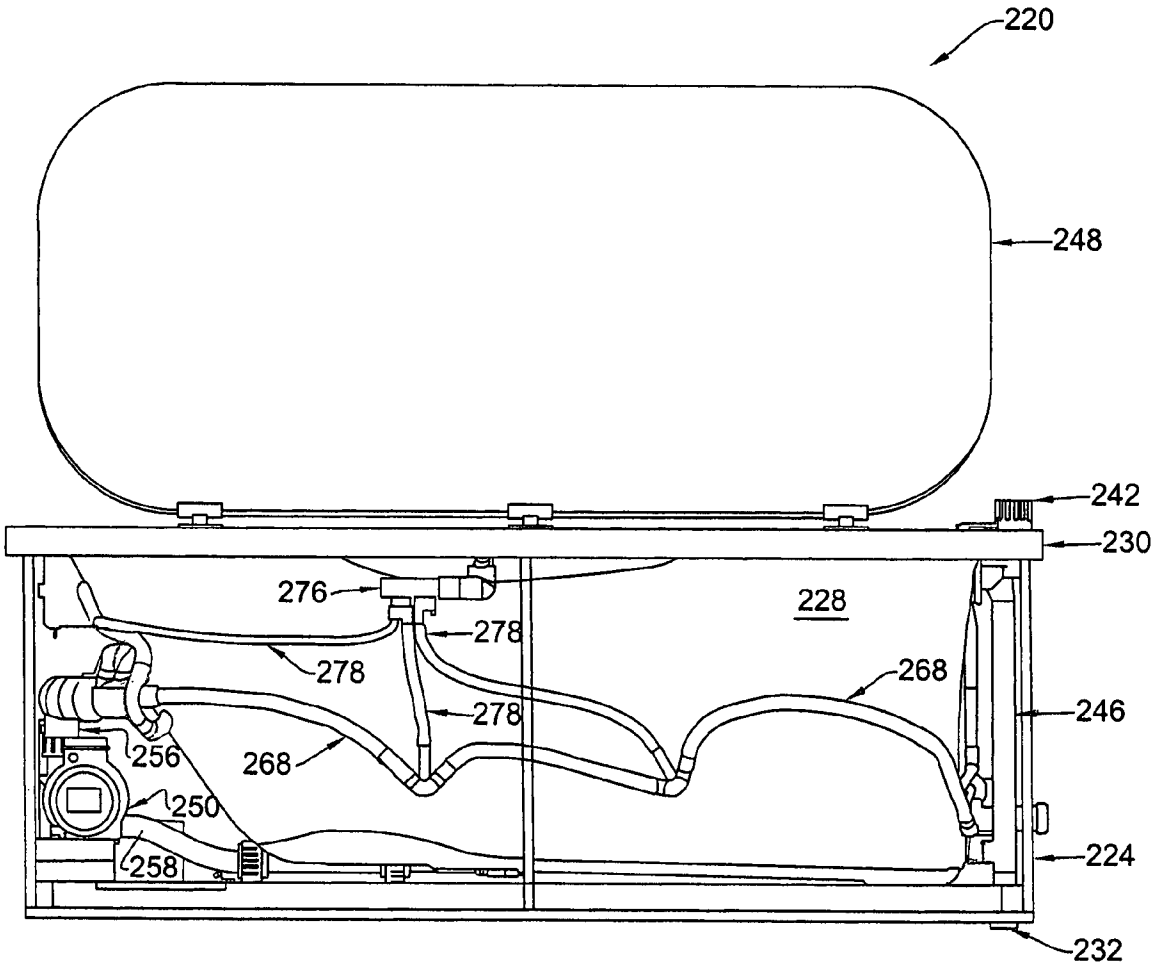
FIG. 10 is a rear view of the embodiment of the invention illustrated in FIGS. 8 and 9.
Figure 11:
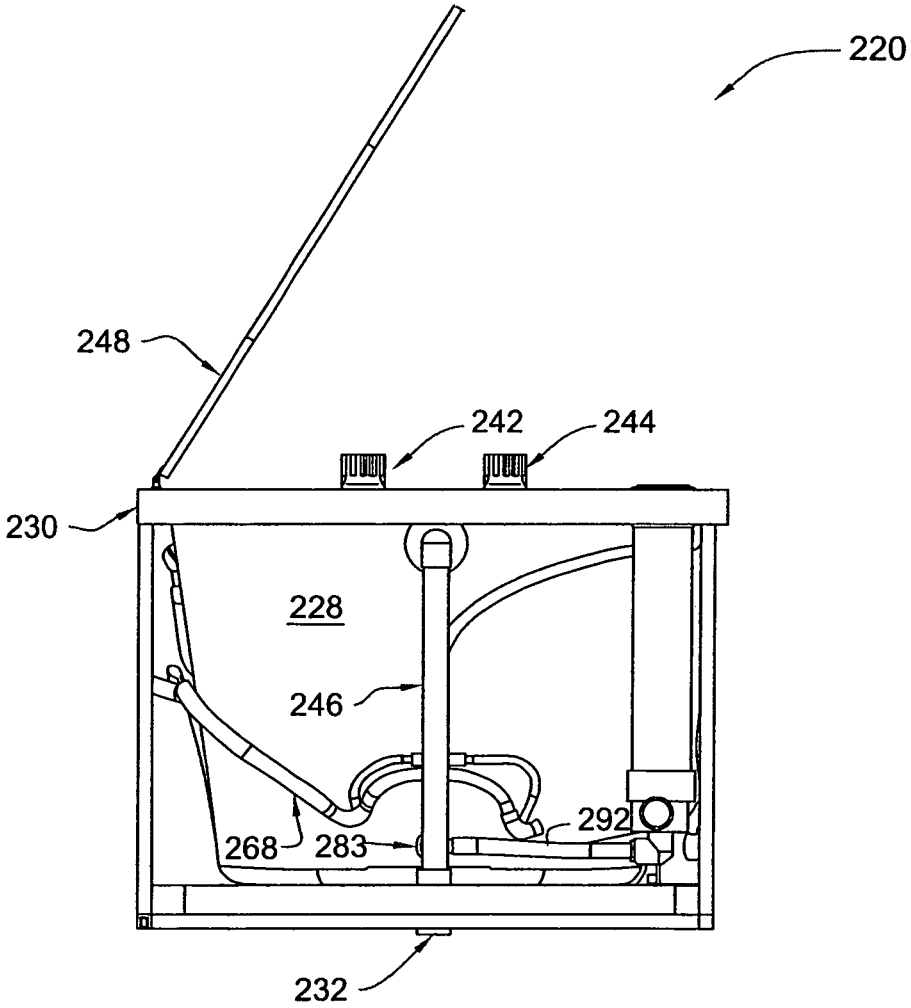
FIG. 11 is a left side view of the embodiment of the invention illustrated in FIGS. 8-10.
Figure 12:
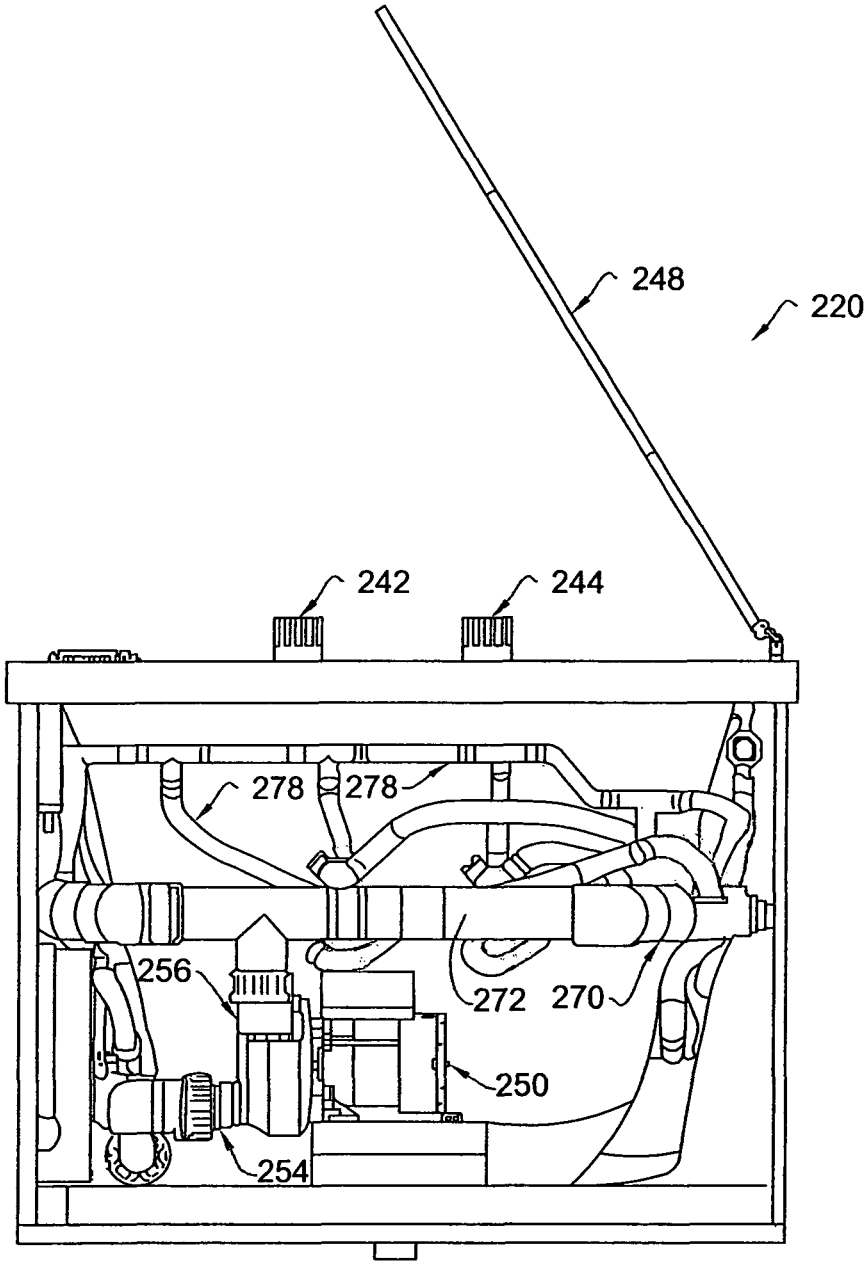
FIG. 12 is a right side view of the embodiment of the invention illustrated in FIGS. 8-11.

FIG. 7 illustrates a second embodiment of the invention that is similar to that shown in FIGS. 1-6, in that it comprises a combination bathtub and spa utilizing a single pump. As shown in FIG. 7, combination bathtub and spa 120 comprises tub enclosure 122 that is adapted to contain a quantity of water and is supported by base 125. Like tub enclosure 22, tub enclosure 122 comprises tub floor 126 and upstanding sidewall 128 which is integrally attached to and surrounds the floor. Combination 120 also includes supporting rim 130, which is disposed around and integrally attached to the sidewall. Combination 120 also includes drain 132 that is mounted in the floor of the tub enclosure and a conventional drain valve (not shown) that may be opened to drain water from the tub enclosure, or closed to retain water therein. Water is supplied to the tub enclosure by means of cold and hot water supply lines (not shown), and the flow of water is directed through faucet 140 by cold water valve 142 and hot water valve 144. Each of valves 142 and 144 is connected to its associated supply line and is operable by a user to open to allow the flow of water through the supply line, or to close to stop the flow of water through the supply line. Combination 120 also includes overflow drain inlet 145 and overflow drain pipe 146 that connects the overflow inlet and drain 132. Combination 120 also includes tub enclosure lid 148, which is hinged to supporting rim 130 along one side.

Combination bathtub and spa 120 includes pump 150, which is mounted for convenience on base 125 and which includes inlet 154 and outlet 156. Inlet line 155 is attached to the pump inlet, and first suction line 158 extends from first port 159 located in the sidewall of tub enclosure 122 to inlet line 155 to provide a path for water from the tub enclosure to pump inlet 154. Pump 150, like pump 50 of combination 20, is adapted to selectively operate at a low flow rate and at a high flow rate.

Combination 120 also includes filter 186 and second port 187, which is located in the sidewall of the tub enclosure. Second suction line 188 extends from second port 187 to filter inlet 189 to provide a path for water from the tub enclosure to filter 186. Filtered water passes out of filter 186 through filter outlet 190 to inlet line 155. A control valve, such as solenoid valve 192 (similar to valve 90 of embodiment 20) or another user-controlled valve, is mounted within inlet line 155 and is adapted to be opened to allow the flow of filtered water through line 155 or closed to stop such flow.

Heater 160 is mounted in inlet line 155 and is adapted to be activated to heat the water therein. Combination 120 also includes a plurality of jet nozzles 166 mounted in the sidewall of the tub enclosure. Each jet nozzle is connected by one or more jet nozzle supply lines 168 to water manifold 170, which is connected to outlet 156 of pump 150. Air control valve 174 is mounted in supporting rim 130 and operatively attached to air manifold 176. A plurality of air lines 178 are provided to connect the air manifold to each nozzle, so that by operating the air control valve in a conventional manner, air may be mixed with water at each nozzle so that a mixture of air and water may be injected into the tub enclosure through each of the nozzles.

Combination 120 includes a sanitizer such as ozone generator 180, which is adapted to sanitize water flowing into the tub enclosure, similar to ozone generator 80 of combination 20. Ozone generator 180 is mounted on the outside of tub sidewall 128 and is adapted to inject ozone into jet nozzle supply line 168*a*. A depth sensor (not shown, but similar to depth sensor 94 of combination 20) is mounted through the sidewall of the tub enclosure and adapted to sense when the depth of water in the tub enclosure is at least as high as, or below, a predetermined level. Controller 198 (similar to controller 98 of combination 20) is operatively attached to the depth sensor and to pump 150, and is adapted to render the pump operative when the level of water in the tub enclosure is at or above the predetermined level, and inoperative when the level of water in the tub enclosure is below the predetermined level.

Controller 198 is mounted in a convenient location on base 125, and an operator's control panel 200 is mounted in supporting rim 130 for easy access to a user, either from within or outside of the tub enclosure. Control panel 200 includes a control switch which may be operated by a user to switch between a bathtub mode and a spa mode, and a heater switch that is operatively connected to the heater. The heater switch is operable by a user to adjust the temperature of the water flowing into the tub enclosure. Controller 198 is operatively connected (by means known to those having ordinary skill in the art to which the invention relates) to control panel 200, control valve 192, ozone generator 180, heater 160, a water temperature sensor (not shown), pump 150 and the depth sensor. If air control valve 174 is adapted to be operated by a switch, the switch will also be connected to controller 198.

A user may close drain 132 and manipulate valves 142 and 144 to allow the flow of water from the supply lines into the tub enclosure. In a preferred embodiment of combination 120, if the depth sensor indicates that there is water in the enclosure at or above the predetermined level, controller 198 will automatically set the control switch to the spa mode, will enable pump 150, heater 160 and ozone generator 180 to operate, and will open valve 192 to allow water to enter filter 186. In the spa mode, the controller will also cause the pump to operate at the low-flow rate, will cause the heater to operate at a low (or default) rate, and will cause the ozone generator to operate so that water in the enclosure remains heated, filtered and sanitized. A user may adjust the flow rate of pump 150 or the temperature of the water in the enclosure by employing control panel 200. Of course, the user may also reset the control switch to the bathtub mode, if desired.

When combination 120 is operated in the spa mode, the controller will open valve 192 so that water may enter filter 186 and will render pump 150 operable, as mentioned above. Pump 150 may then be operated by a user at either the low-flow rate or the high-flow rate, by setting the flow rate on control panel 200. With valve 192 remaining open, activating the pump at either the low-flow rate or the high-flow rate will cause water to flow out of the tub enclosure simultaneously through first port 159 and first suction line 158 into pump inlet line 155 and through second port 187 and second suction line 188 into filter inlet 189. Water flowing into filter inlet 189 will enter filter 186. Filtered water will pass out of filter 186 through filter outlet 190 and into pump inlet line 155. The water may be heated as it passes through heater 160, as controlled by the user from control panel 200. The filtered (and optionally heated) water will pass out of pump outlet 156 and into water manifold 170. From manifold 170, water will be passed through various jet nozzle supply lines 168 and into the tub enclosure through jet nozzles 166. A user may also open air control valve 174, manually or by means of control panel 200, causing air to be drawn through air manifold 176 and air lines 178 to be mixed with water at each nozzle so that a mixture of air and water may be injected into the tub enclosure through each of the nozzles.

If the depth sensor indicates that the water level in the enclosure is below the predetermined level, controller 198 will lock the control switch in the bathtub mode setting, will close valve 192, and will disable pump 150, heater 160 and ozone generator 180 from operation. Of course, if the depth sensor subsequently indicates that the water level in the enclosure is at or above the predetermined level, controller 198 will set the control switch to the spa mode.

If a user sets the control switch of embodiment 120 to the bathtub mode, controller 198 will close control valve 192 to prevent the flow of water through the filter. With valve 192 remaining closed (and the water level at or above the predetermined level at which controller will permit pump 150 to operate), activating pump 150 at either the low-flow rate or the high-flow rate will cause water to flow from the tub enclosure through first port 159 and first suction line 158 into pump inlet line 155, past heater 160, into pump inlet 154, out pump outlet 156 and into water manifold 170. The water may be heated as it passes through heater 160, as controlled by the user from control panel 200. From manifold 170, water will be passed through various jet nozzle supply lines 168 and into the tub enclosure through jet nozzles 166. A user may also open air control valve 174, manually or by means of control panel 200, causing air to be drawn through air manifold 176 and air lines 178 to be mixed with water at each nozzle so that a mixture of air and water may be injected into the tub enclosure through each of the nozzles. When a user finishes bathing, the drain valve may be opened to drain the water from the tub enclosure through drain 132.

FIGS. 8-12 illustrate a third embodiment of the invention that is similar to embodiment 20 and embodiment 120, in that it comprises a combination bathtub and spa utilizing a single pump. As shown therein, combination bathtub and spa 220 comprises tub enclosure 222 that is adapted to contain a quantity of water and is supported by frame 224. Tub enclosure 222 comprises tub floor 226 and upstanding sidewall 228 which is integrally attached to and surrounds the floor. Combination 220 also includes supporting rim 230, which is disposed around and integrally attached to the sidewall. Combination 220 also includes drain 232 that is mounted in the floor of the tub enclosure and a drain valve that may be opened to drain water from the tub enclosure, or closed to retain water therein. Water is supplied to the tub enclosure by means of cold and hot water supply lines (not shown), and the flow of water is directed through the faucet portion of combination faucet/overflow drain fixture 240 by cold water valve 242 and hot water valve 244. Each of valves 242 and 244 is connected to an associated supply line (not shown) and is operable by a user to open to allow the flow of water through the supply line, or to close to stop the flow of water through the supply line. Combination 220 also includes overflow drain pipe 246 (best shown in FIG. 11) that connects the overflow inlet of combination faucet/overflow drain fixture 240 and the drain. Combination 220 also includes tub enclosure lid 248, which is hinged to supporting rim 230 along one side.

Combination bathtub and spa 220 includes pump 250, which is mounted for convenience on pedestal 252 and which includes inlet 254 and outlet 256. Suction line 258 (best shown in FIG. 9) extends through sidewall 228 of the tub enclosure to provide a path for water from the tub enclosure to the inlet of the pump, and heater 260 is mounted in suction line 258. Pump 250 is adapted to selectively operate at a low flow rate and at a high flow rate, in a manner similar to pump 50.

Combination 220 also includes a plurality of jet nozzles 266 mounted in sidewall 228 of the tub enclosure, each of which is connected by one or more jet nozzle supply lines 268 to water manifold 270, and water manifold 270 is connected to a first control valve such as pressure-sensitive bypass valve 272. Preferably, bypass valve 272 is spring-loaded so that when the pump is operated at a low flow rate, the valve will remain closed, but when it is operated at a high flow rate, the valve will open. In the alternative, the first control valve may be a solenoid valve or other user-controllable valve known to those having ordinary skill in the art to which the invention relates. Air control valve 274 is mounted near the top of the tub enclosure and operatively attached to air manifold 276. This air control valve may be adapted to be operated manually by a user to admit air (when open) or to restrict the flow of air (when closed) into the air manifold, or it may be opened and closed by a switch. In either event, a plurality of air lines 278 are provided to connect the air manifold to each nozzle, so that by opening the air control valve, air may be mixed with water at each nozzle (in a manner known to those having ordinary skill in the art to which the invention relates) so that a mixture of air and water may be injected into the tub enclosure through each of the nozzles.

Combination 220 includes a sanitizer such as ozone generator 280, which is adapted to sanitize water flowing into the tub enclosure. Ozone generator 280 is adapted to generate ozone, which is then injected into jet nozzle 283 through ozone outlet line 284. Combination 220 also includes filter 286, which is connected to a second control valve such as manual valve 290, which is mounted to supporting rim 230. Control valve 290 is operatively connected to the outlet of pump 250 by pump discharge line 257 and control line 288.

Control valve 290 is also operatively connected to filter inlet line 289. Valve 290 serves as a control switch which may be operated by a user to switch between a bathtub mode and a spa mode. As such, valve 290 is adapted to be opened to allow the flow of water through lines 288 and 289 and into filter 286, or closed to stop such flow. Filter outlet line 292 extends from the outlet of filter 286 to jet nozzle 283, to which ozone outlet line 284 is also attached, thereby providing a path for filtered water from the filter to the tub enclosure.

A depth sensor (not shown but similar to depth sensor 94 of embodiment 20) is mounted through the sidewall of the tub enclosure and adapted to sense when the depth of water in the tub enclosure is at least as high as, or below, a predetermined level. Controller 298 is operatively attached to the depth sensor and to pump 250, and is adapted to render the pump operative when the level of water in the tub enclosure is at or above the predetermined level, and inoperative when the level of water in the tub enclosure is below the predetermined level.

Controller 298 is mounted in a convenient location within frame 224, and an operator's control panel 300 is mounted in supporting rim 230 for easy access to a user, either from within or outside of the tub enclosure. Control panel 300 includes a heater switch that is operatively connected to the heater, which heater switch is operable by a user to adjust the temperature of the water flowing into the tub enclosure. Controller 298 is operatively connected (by means known to those having ordinary skill in the art to which the invention relates) to control panel 300, pump 250, heater 260, a temperature sensor for water in the enclosure (not shown), ozone generator 280 and the depth sensor. If air control valve 274 is adapted to be operated by a switch, the switch will also be connected to controller 298.

A user may close drain 232 and manipulate valves 242 and 244 to allow the flow of water from the supply lines into the tub enclosure. In a preferred embodiment of combination 220, if the depth sensor indicates that there is water in the enclosure at or above the predetermined level and control valve 290 is open, controller 298 will enable pump 250, heater 260 and ozone generator 280 to operate. In the spa mode, the controller will also cause the pump to operate at the low-flow rate, will cause the heater to operate at a low (or default) rate, and will cause the ozone generator to operate so that water in the enclosure remains heated, filtered and sanitized. A user may adjust the flow rate of pump 250 or the temperature of the water in the enclosure by employing control panel 300. Of course, the user may also close control valve 290, thereby putting combination 220 in the bathtub mode, if desired.

When combination 220 is operated in the spa mode, open valve 290 will allow water to enter filter 286. Controller 298 will render pump 250 operable at either the low-flow rate or the high-flow rate, and the user may select the flow rate on control panel 300. With valve 290 remaining open, activating the pump at either the low-flow rate or the high-flow rate will cause water to flow out of the pump, through discharge line 257, line 288, filter inlet line 289 and into filter 286. Filtered water will then pass out of filter 286 through filter outlet line 292 and into the tub enclosure through the associated jet nozzle. If the pump is operated at the low-flow rate, the pressure in the discharge line from the pump will not be high enough to open control valve 272, and water will not flow into water manifold 270. However, if pump 250 is operated at the high-flow rate, even with valve 290 open, the pressure in the pump discharge line will be high enough to open valve 272, so that water may also flow into water manifold 270 (as well as through filter 286). From manifold 270, water will be passed through various jet nozzle supply lines and into the tub enclosure through the associated jet nozzles. A user may also open air control valve 274, manually or by means of control panel 300, causing air to be drawn through the air manifold and air lines to be mixed with water at each nozzle so that a mixture of air and water may be injected into the tub enclosure through each of the nozzles.

If the depth sensor indicates that the water level in the enclosure is below the predetermined level, controller 298 will disable pump 250, heater 260 and ozone generator 280 from operating. Of course, if the depth sensor subsequently indicates that the water level in the enclosure is at or above the predetermined level, controller 298 will enable the pump, heater and ozone generator.

If a user closes valve 290 so that combination 220 is in the bathtub mode (and the water level at or above the predetermined level at which controller will permit pump 250 to operate), activating the pump at either the low-flow rate or the high-flow rate will cause pressure to increase in the portion jet flow circuit comprising pump discharge line 257 and line 288. This increase in pressure will cause valve 272 to open (or to remain open). Water will then flow out of pump 250 and past valve 272 into water manifold 270. From manifold 270, water will be passed through various jet nozzle supply lines and into the tub enclosure through the jet nozzles. A user may also open air control valve 274, manually or by means of control panel 300, causing air to be drawn through the air manifold and the air lines to be mixed with water at each nozzle so that a mixture of air and water may be injected into the tub enclosure through each of the nozzles. When a user finishes bathing, the drain valve may be opened to drain the water from the tub enclosure.

Figure 13:
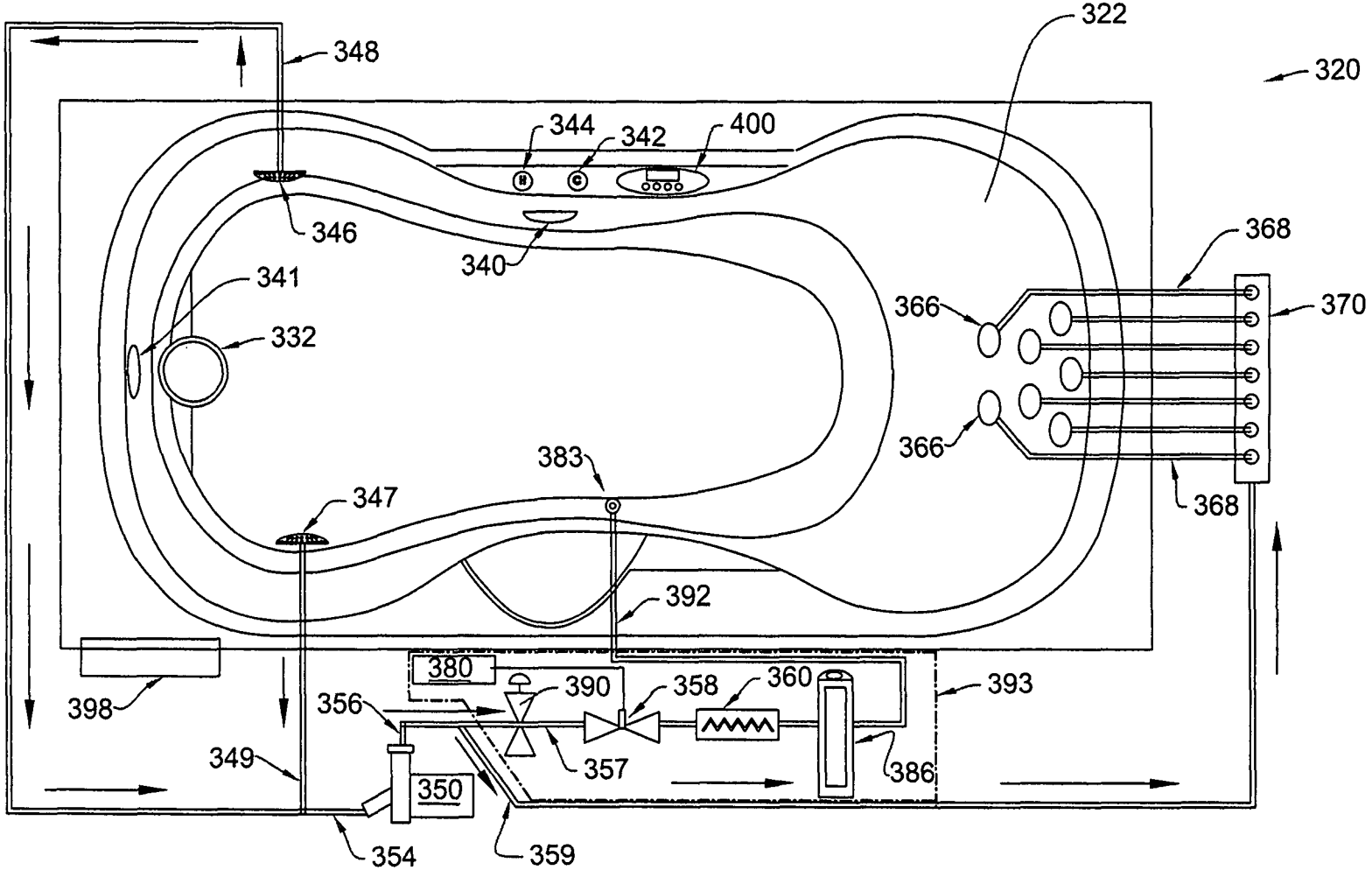
FIG. 13 is a schematic view of a fourth embodiment of the invention, showing a combination bathtub and spa utilizing a single pump.
Figure 14:
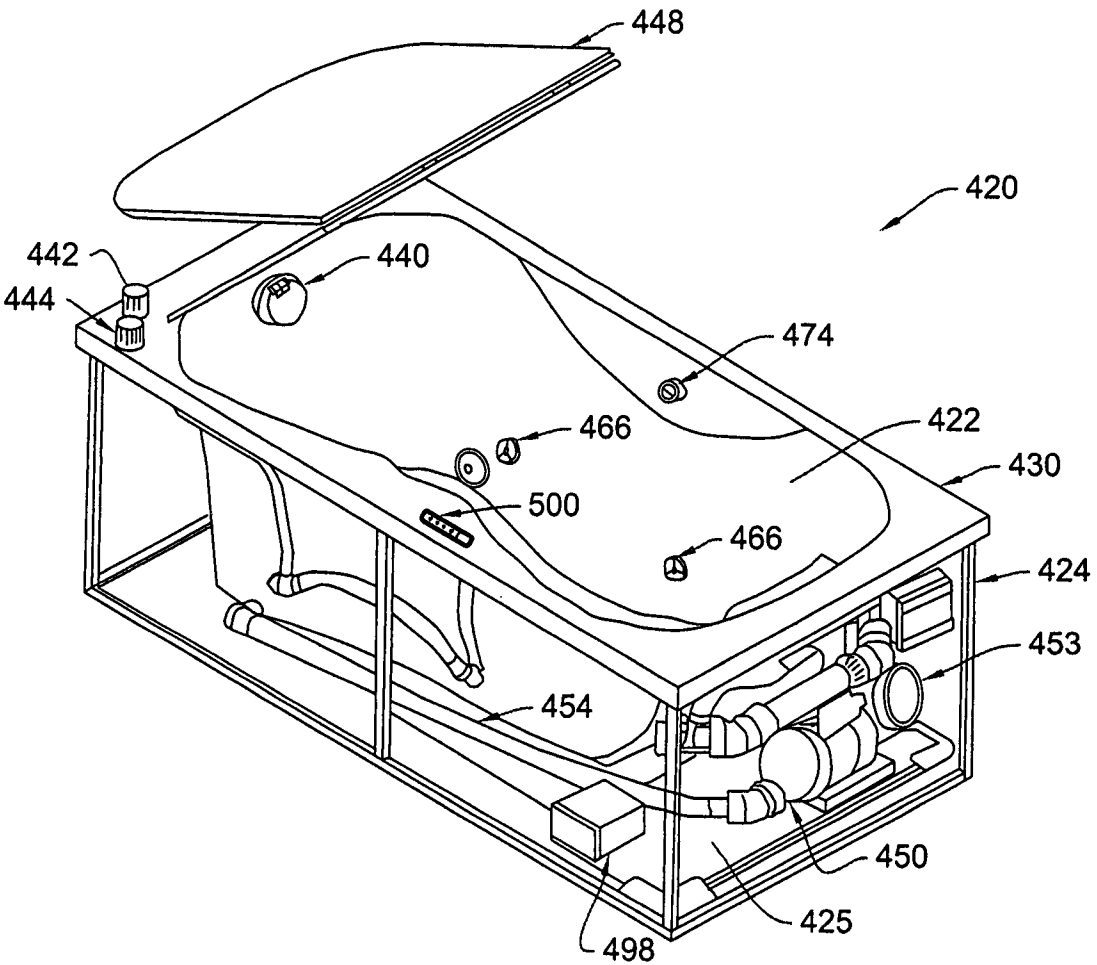
FIG. 14 is a top perspective view of a fifth embodiment of the invention, showing a combination bathtub and spa utilizing a pair of pumps.

FIG. 13 illustrates a fourth embodiment of the invention that is similar to embodiments 20, 120 and 220, in that it comprises a combination bathtub and spa 320 utilizing a single pump. As shown therein, drain 332 is mounted in the floor of tub enclosure 322, and overflow drain 341 is mounted in the sidewall adjacent to drain 332. Faucet 340 is provided for the introduction of water into the tub enclosure, as controlled by cold water valve 342 and hot water valve 344. A pair of suction ports 346 and 347 in the sidewall of the tub enclosure are connected by suction lines 348 and 349 respectively to inlet line 354 of pump 350, which is adapted to selectively operate at a low flow rate and at a high flow rate. A depth sensor (not shown but similar to depth sensor 94 of embodiment 20) is mounted through the sidewall of the tub enclosure and adapted to sense when the depth of water in the tub enclosure is at least as high as, or below, a predetermined level. Control valve 390 may be opened by a user, either manually or electrically, to enable operation of combination 320 in the spa mode, or it may be closed to enable operation of the combination in the bathtub mode.

In a preferred embodiment of combination 320, if the depth sensor indicates that there is water in the enclosure at or above the predetermined level and control valve 390 is open, controller 398 will enable pump 350, heater 360 and ozone generator 380 to operate. If the depth sensor indicates that the water level in the enclosure is below the predetermined level, controller 398 will lock valve 390 in the bathtub mode (closed) setting and will disable pump 350, heater 360 and ozone generator 380 from operating. Of course, if the depth sensor subsequently indicates that the water level in the enclosure is at or above the predetermined level, controller 398 will permit the user to open control valve 390, thereby initiating the spa mode.

When there is sufficient water in the tub enclosure to enable operation in the spa mode, the opening of valve 390 and the actuation of pump 350 will cause water to flow out of pump 350 through outlet line 356, into line 357, and through heater 360 and filter 386. Ozone may be generated by ozone generator 380 and injected into line 357 at 358. Filtered (and optionally heated and sanitized) water exits filter 386 through line 392 and is introduced into the tub enclosure through nozzle 383. Lines 357 and 392, heater 360, filter 386 and ozone generator 380 together comprise a circulating flow circuit, as indicated by box 393 of FIG. 13.

Combination 320 also includes a jet flow circuit comprising line 359, water manifold 370 and a plurality of jet nozzles 366 mounted in the sidewall of the tub enclosure. Each jet nozzle is connected by a jet nozzle supply line 368 to water manifold 370. When the tub enclosure contains sufficient water for controller 398 to enable pump 350 to operate, and the pump is operated in either the bathtub mode or the spa mode, water will flow from pump 350 through line 356 and into line 359, water manifold 370 and lines 368, and through jet nozzles 366 into the tub enclosure. A control valve such as a bypass valve (not shown, but similar to bypass valve 72 or bypass valve 272) may be mounted in line 359 and adapted to remain closed when pump 350 is operated at a low flow rate, or to remain open when the pump is operated at a high flow rate. An air control valve (not shown but similar to air control valve 74 of embodiment 20) may be mounted near the top of the tub enclosure and operatively attached to an air manifold (also not shown, but similar to air manifold 76 of embodiment 20). Such air control valve may be adapted to be operated manually by a user to admit air (when open) or to restrict the flow of air (when closed) into the air manifold, or it may be opened and closed by a switch. In either event, a plurality of air lines (not shown) will be provided to connect the air manifold to each nozzle, so that by opening the air control valve, air may be mixed with water at each nozzle (in a manner known to those having ordinary skill in the art to which the invention relates) so that a mixture of air and water may be injected into the tub enclosure through each of the nozzles.

Controller 398 is operatively connected to operator's control panel 400. The control panel may include a switch for operation of control valve 390, in order to provide for operation of combination 320 in either the bathtub mode or the spa mode. Control panel 400 also includes a heater switch that is operatively connected to the heater, as well as a switch which is operatively connected to the ozone generator. Controller 398 is operatively connected (by means known to those having ordinary skill in the art to which the invention relates) to control panel 400 and pump 350, and may also be operatively connected to heater 360, ozone generator 380, control valve 390, a depth sensor (not shown but similar to depth sensor 94 of combination 20) and a temperature sensor for water in the enclosure (also not shown). If combination 320 includes an air control valve that is adapted to be operated by a switch, such switch may also be connected to controller 398.

FIGS. 14-18 illustrate an embodiment of the invention comprising a combination bathtub and spa which utilizes a pair of pumps. As shown therein, combination 420 comprises tub enclosure 422 that is adapted to contain a quantity of water and is supported by frame 424 and base 425. Tub enclosure 422 comprises a tub floor and an upstanding sidewall which is integrally attached to and surrounds the floor. Combination 420 also includes supporting rim 430, which is disposed around at least a portion of the sidewall, and drain 432. Preferably, the supporting rim is integrally attached to the upstanding sidewall. Drain 432 includes a conventional drain valve (not shown) that may be opened to drain water from the tub enclosure, or closed to retain water therein. Water is supplied to the tub enclosure by means of cold and hot water supply lines (not shown), and the flow of water is directed through the faucet portion of combination faucet/overflow drain fixture 440 by cold water valve 442 and hot water valve 444. Each of valves 442 and 444 is connected to its associated supply line and is operable by a user to open to allow the flow of water through the supply line, or to close to stop the flow of water through the supply line. Combination 420 also includes overflow drain pipe 446 (best shown in FIG. 16) that connects the overflow inlet of combination faucet/overflow drain fixture 440 and drain 432. Combination 420 also includes tub enclosure lid 448, which is hinged in the middle to fold upon itself and hinged at one end to supporting rim 430.

Combination bathtub and spa 420 includes jet flow pump 450 and circulating flow pump 453, both of which are mounted for convenience on support 425. Pump 450 includes inlet 451 and outlet 452 (best shown in FIG. 15) and is adapted to supply water to the jet flow circuit. Suction line 454 extends through the sidewall of tub enclosure 422 to provide a path for water from the tub enclosure to the inlet of jet flow pump 450. Heater 460 (best shown in FIG. 15) is mounted to outlet 452 of pump 450 and jet flow manifolds 461 and 462 are mounted on opposite ends of the heater. In an alternative embodiment (not shown), heater 460 may be deleted and jet flow manifolds 461 and 462 may be replaced by a single jet flow manifold. The jet flow circuit of combination 420 also includes a plurality of jet nozzles 466 mounted in the sidewall of the tub enclosure (see FIG. 14). Each jet nozzle is connected by one or more jet nozzle supply lines 468 (shown only in FIG. 15, to avoid clutter in the other drawings) to water manifold 461 or water manifold 462.

Figure 18:
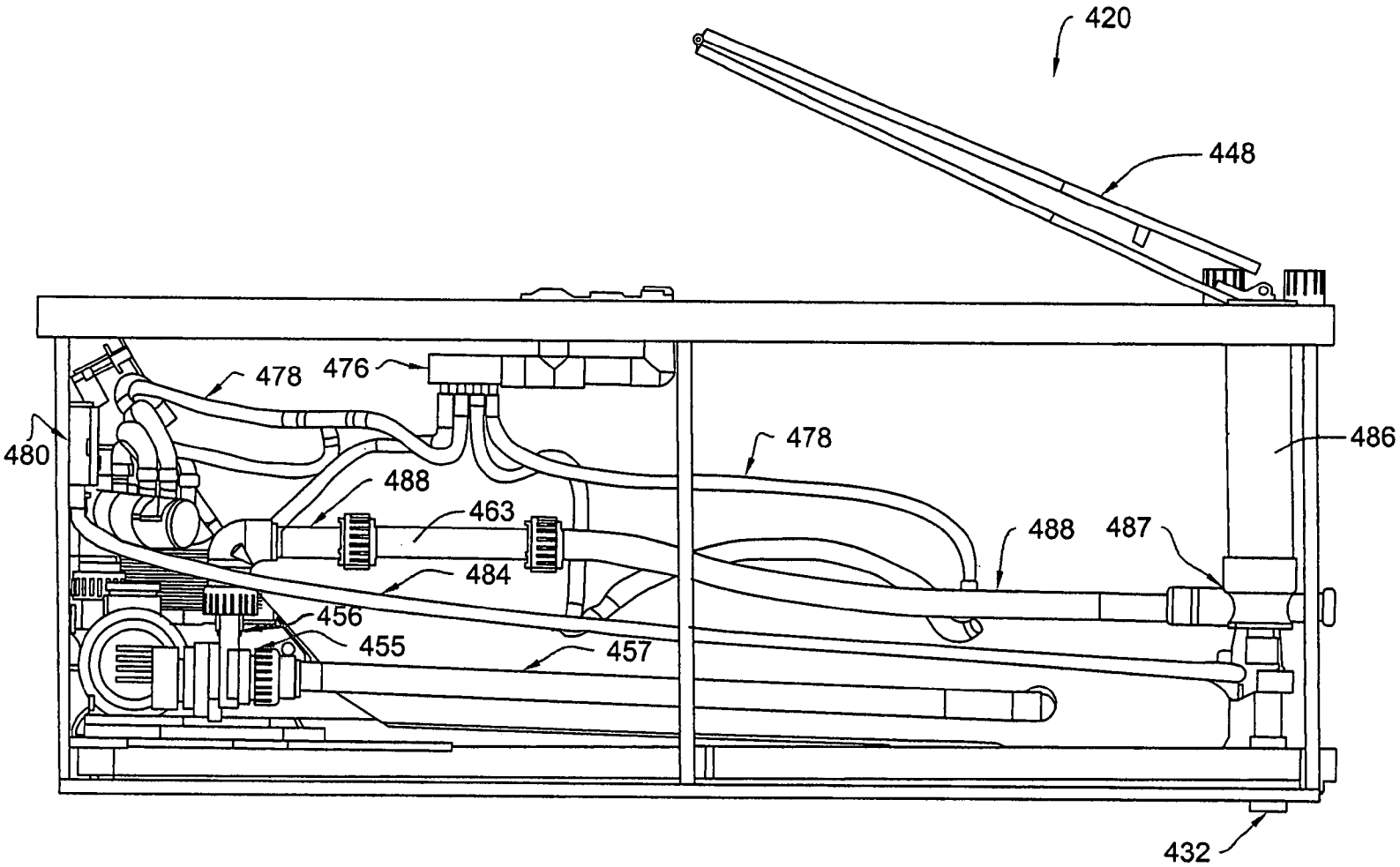
FIG. 18 is a rear side view of the embodiment of the invention illustrated in FIGS. 14-17.

Air control valve 474 is mounted near the top of the tub enclosure and operatively attached to air manifold 476 (shown in FIG. 18). This air control valve may be adapted to be operated manually by a user to admit air (when open) or to restrict the flow of air (when closed) into air manifold 476, or it may be opened and closed by a switch. In either event, a plurality of air lines 478 are provided to connect the air manifold to each nozzle, so that by opening the air control valve, air may be mixed with water at each nozzle (in a manner known to those having ordinary skill in the art to which the invention relates) so that a mixture of air and water may be injected into the tub enclosure through each of the nozzles.

Figure 15:
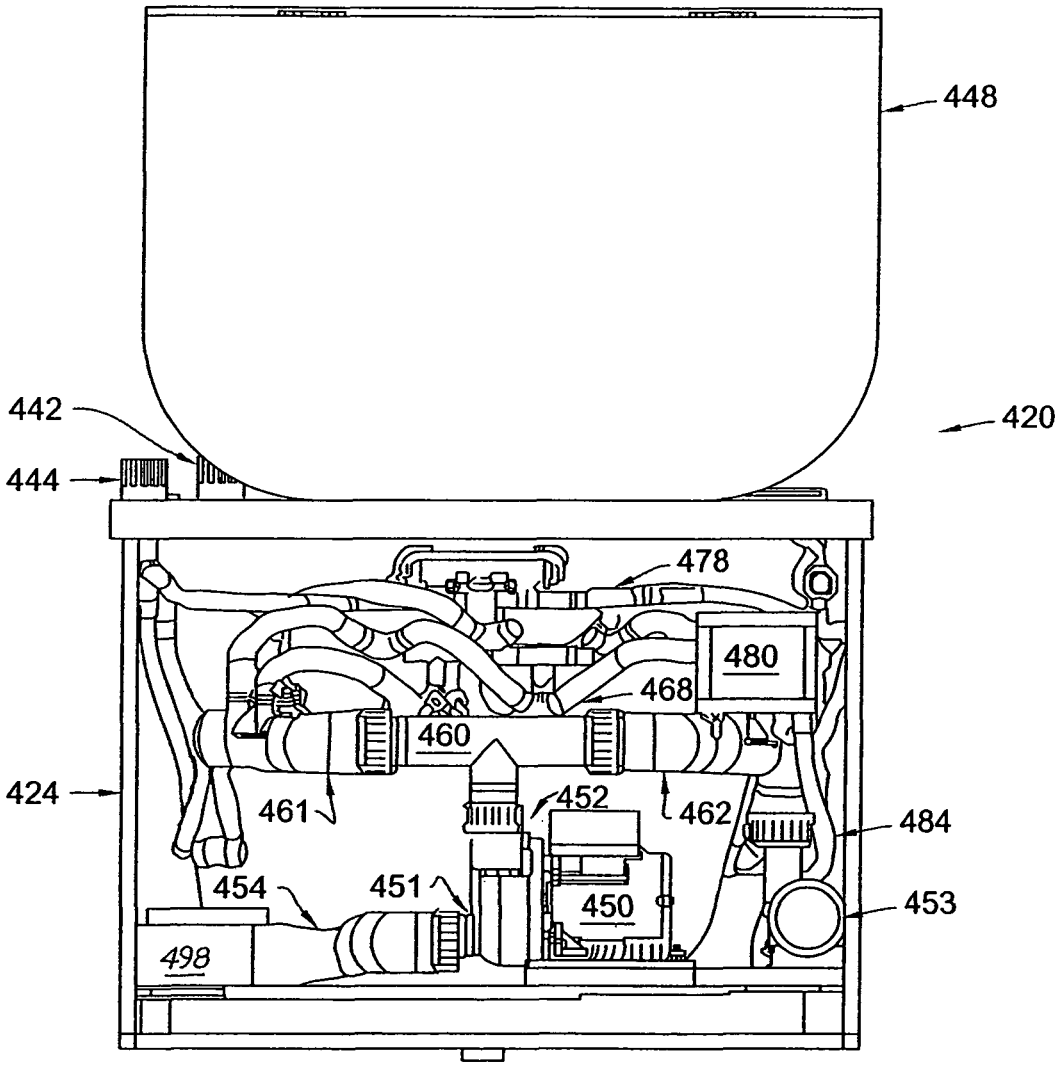
FIG. 15 is a right end view of the embodiment of the invention illustrated in FIG. 14.
Figure 16:
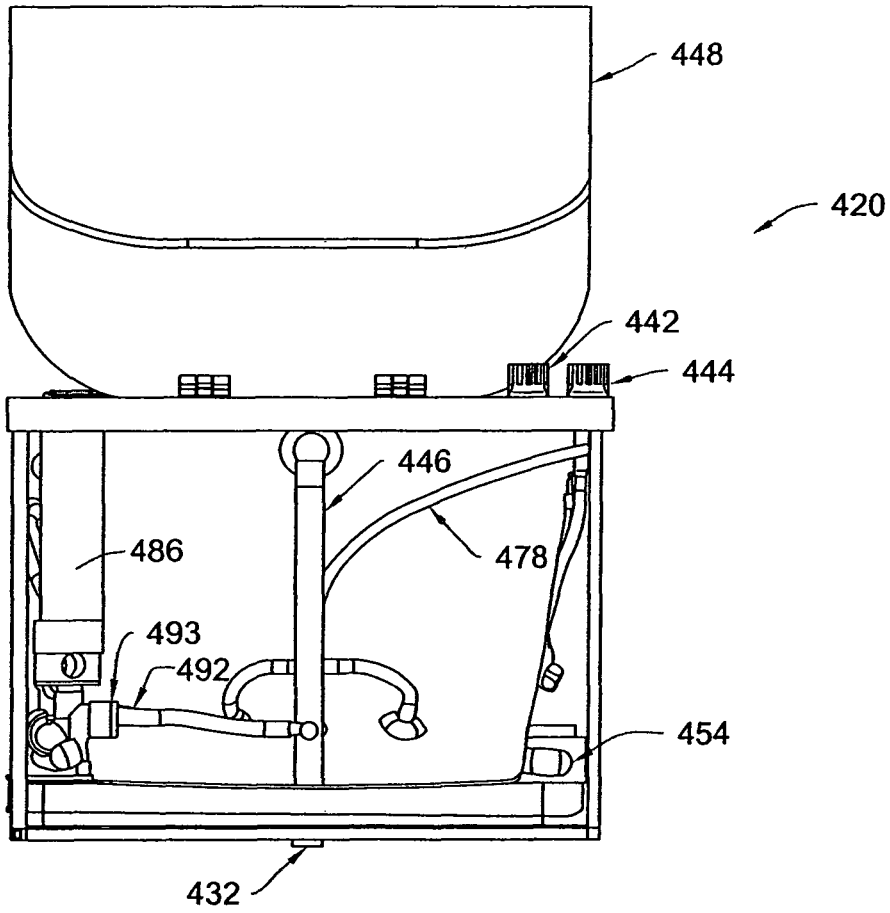
FIG. 16 is a left end view of the embodiment of the invention illustrated in FIGS. 14 and 15.
Figure 17:
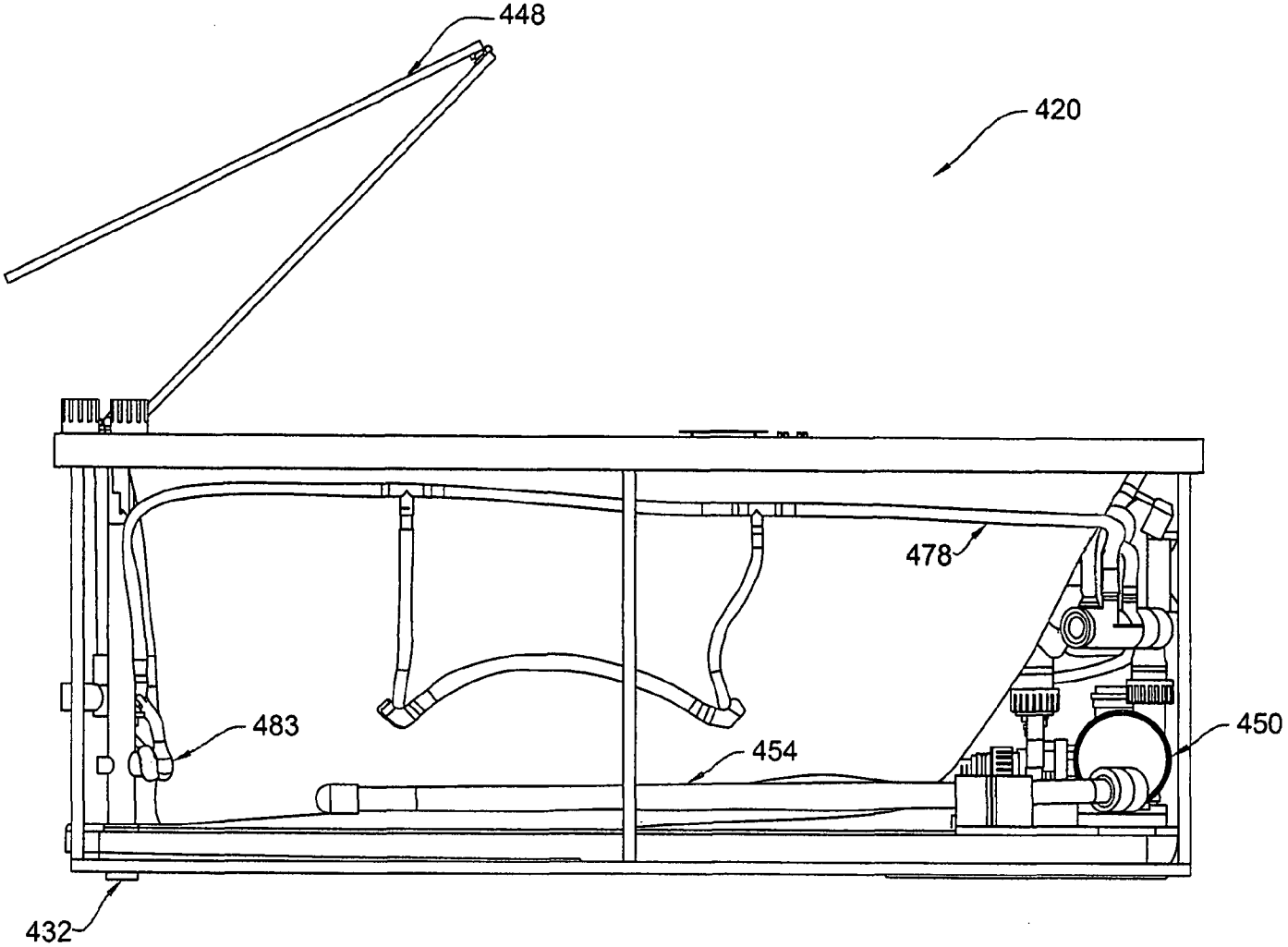
FIG. 17 is a front side view of the embodiment of the invention illustrated in FIGS. 14-16.

Circulating flow pump 453 has inlet 455 and outlet 456 and is adapted to supply water to the circulating flow circuit. Suction line 457 extends through the sidewall of tub enclosure 422 to provide a path for water from the tub enclosure to inlet 455 of the circulating flow pump. The circulating flow circuit also includes filter 486, having filter inlet 487, and filter inlet line 488, which includes heater 463 and connects outlet 456 of circulating pump 452 and filter inlet 487. Heater 463 serves to heat the water passing out of outlet 456 of pump 453 on its way to filter 486. Filter outlet line 492 (best shown in FIG. 16) extends from outlet 493 of filter 486 to jet nozzle 483 (shown in FIG. 17), thereby providing a path for filtered water from the filter to the tub enclosure. Combination 420 also includes a sanitizer such as ozone generator 480, which is adapted to generate ozone and inject it into water flowing into the tub enclosure. As best shown in FIGS. 15 and 18, ozone outlet line 484 is attached to ozone generator 480 to provide a path for ozone into nozzle 483.

A depth sensor (not shown but similar to depth sensor 94 of embodiment 20) may be mounted through the sidewall of the tub enclosure and adapted to sense when the depth of water in the tub enclosure is at least as high as, or below, a predetermined level. Controller 498 is operatively attached to the depth sensor and to each of pumps 450 and 453 to render the pumps operative when the level of water in the tub enclosure is at or above the predetermined level, and inoperative when the level of water in the tub enclosure is below the predetermined level.

Controller 498 is mounted on base 425, and an operator's control panel 500 (see FIG. 14) is mounted in supporting rim 430 for easy access to a user, either from within or outside of the tub enclosure. Control panel 500 includes a control switch which may be operated by a user to switch between a bathtub mode and a spa mode. As will be described in more detail hereinafter, control panel 500 includes a heater switch that is operatively connected to the heaters, which heater switch is operable by a user to adjust the temperature of the water flowing into the tub enclosure. Controller 498 is operatively connected (by means known to those having ordinary skill in the art to which the invention relates) to control panel 500, pumps 450 and 453, heaters 460 and 463, a temperature sensor for water in the enclosure (not shown), ozone generator 480 and the depth sensor. If air control valve 474 is adapted to be operated by a switch, the switch will also be connected to controller 498.

A user may close drain 432 and manipulate valves 442 and 444 to allow the flow of water from the supply lines into the tub enclosure. In a preferred embodiment of combination 420, if the depth sensor indicates that there is water in the enclosure at or above the predetermined level, controller 498 will set the control switch to the spa mode, and will enable jet flow pump 450 to operate and will cause circulating pump 453 to operate. The controller will also cause heater 463 to operate at a low (or default) setting, and will also cause the ozone generator to operate so that water in the enclosure remains heated, filtered and sanitized. The temperature of the water in the enclosure may be adjusted by employing control panel 500. Of course, a user may also reset the control switch to the bathtub mode, if desired.

When combination 420 is operated in the spa mode, water will flow out of tub enclosure 422 through suction line 457 into inlet 455 of pump 453 and out of outlet 456 of the circulating flow pump through filter inlet line 488, past heater 463 and into filter 486. Filtered water will then pass out of filter 486 through filter outlet line 492 and into the tub enclosure through jet nozzle 483. If the jet pump is activated by a user, water will also flow out of pump 450 into heater 460 and through water manifolds 461 and 462. The water may be heated as it passes through heater 460, as controlled by the user from control panel 500. From manifolds 461 and 462, water will be passed through various jet nozzle supply lines 468 and into the tub enclosure through jet nozzles 466. A user may also open air control valve 474, manually or by means of control panel 500, causing air to be drawn through air manifold 476 and air lines 478 to be mixed with water at each nozzle so that a mixture of air and water may be injected into the tub enclosure through each of the nozzles.

If the depth sensor indicates that the water level in the enclosure is below the predetermined level, controller 498 will lock the control switch in the bathtub mode setting, and will disable pumps 450 and 453, heaters 460 and 463, and ozone generator 480 from operation. Of course, if the depth sensor subsequently indicates that the water level in the enclosure is at or above the predetermined level, controller 498 will set the control switch to the spa mode.

If a user sets the control switch to the bathtub mode, controller 498 will disable circulating flow pump 453 and render jet flow pump 450 operable (if the level of water in the enclosure is at or above the predetermined level). Water will then flow out of pump 450, through heater 460 and water manifolds 461 and 462. The water may be heated as it passes through heater 460, as controlled by the user from control panel 500. From manifolds 461 and 462, water will be passed through various jet nozzle supply lines 468 and into the tub enclosure through jet nozzles 466. A user may also open air control valve 474, manually or by means of control panel 500, causing air to be drawn through air manifold 476 and air lines 478 to be mixed with water at each nozzle so that a mixture of air and water may be injected into the tub enclosure through each of the nozzles. When a user finishes bathing, the drain valve may be opened to drain the water from the tub enclosure.

Figure 19A:
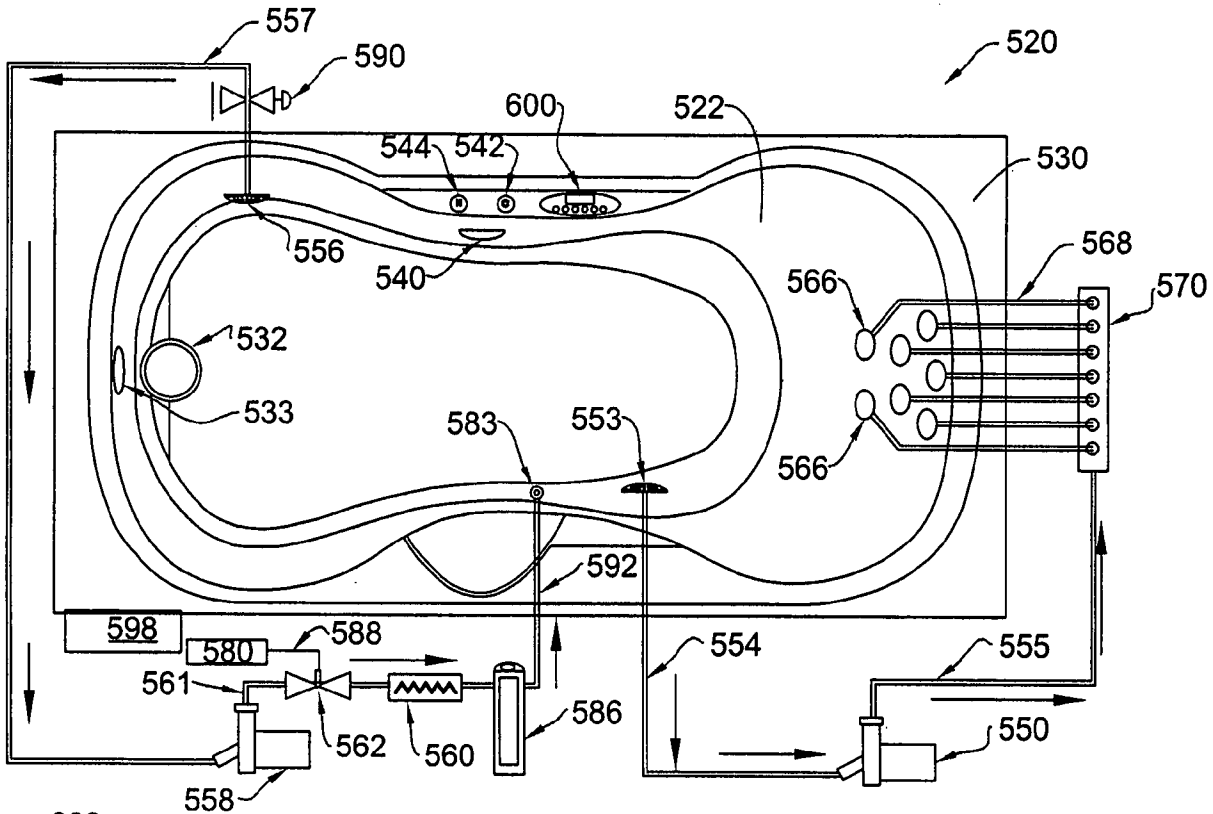
FIG. 19A is a schematic view of a sixth embodiment of the invention, showing a combination bathtub and spa utilizing a pair of pumps.
Figure 19B:
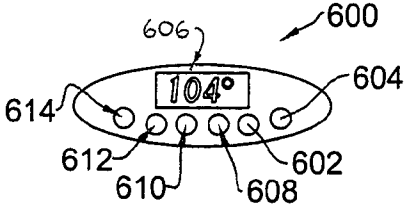
FIG. 19B is a detailed view of the control panel for the embodiment of the invention shown in FIG. 19A.

FIGS. 19A and 19B illustrate another embodiment of the invention comprising a combination bathtub and spa which utilizes a pair of pumps. As shown therein, combination 520 comprises tub enclosure 522 that comprises a tub floor and an upstanding sidewall which is integrally attached to and surrounds the floor. Combination 520 also includes supporting rim 530, which is disposed around at least a portion of the sidewall, drain 532 and overflow drain 533. Preferably, the supporting rim is integrally attached to the upstanding sidewall. Drain 532 includes a conventional drain valve (not shown) that may be opened to drain water from the tub enclosure, or closed to retain water therein. Water is supplied to the tub enclosure by means of cold and hot water supply lines (not shown), and the flow of water is directed through faucet 540 by cold water valve 542 and hot water valve 544. Each of valves 542 and 544 is connected to its associated supply line and is operable by a user to open to allow the flow of water through the supply line, or to close to stop the flow of water through the supply line. Combination bathtub and spa 520 includes jet flow pump 550 and circulating flow pump 558.

Suction port 553 in the sidewall of the tub enclosure is connected by suction line 554 to jet flow pump 550 to provide a path for water from the tub enclosure to the inlet of the pump. Outlet line 555 is provided to connect the outlet of pump 550 to water manifold 570. The jet flow circuit of combination 520 also includes a plurality of jet nozzles 566 mounted in the sidewall of the tub enclosure, each of which is connected by one or more jet nozzle supply lines 568 to water manifold 570.

An air control valve similar to valve 474 of embodiment 420 may be provided near the top of the tub enclosure. Such air control valve will preferably be operatively attached to an air manifold similar to air manifold 476, and the air control valve may be adapted to be operated manually by a user to admit air (when open) or to restrict the flow of air (when closed) into the air manifold, or it may be opened and closed by a switch. In either event, a plurality of air lines will be provided to connect the air manifold to each jet nozzle 566, so that by opening the air control valve, air may be mixed with water at each nozzle (in a manner known to those having ordinary skill in the art to which the invention relates) so that a mixture of air and water may be injected into the tub enclosure through each of the nozzles.

Suction port 556 is attached to suction line 557, which extends through the sidewall of tub enclosure 522 to provide a path for water from the tub enclosure to the inlet of circulating flow pump 558. Control valve 590 is mounted in suction line 557 and adapted to be opened to allow flow into and out of circulating flow pump 558, or closed to prevent such flow. Heater 560 is mounted in line 561 to heat the water therein. Line 561 connects the outlet of pump 558 and the inlet of filter 586. Filter outlet line 592 extends from the outlet of filter 586 to jet nozzle 583, thereby providing a path for filtered water from the filter to the tub enclosure. Combination 520 also includes a sanitizer such as ozone generator 580, which is adapted to generate ozone and inject it into water flowing through line 561.

A depth sensor (not shown but similar to depth sensor 94 of embodiment 20) may be mounted through the sidewall of the tub enclosure and adapted to sense when the depth of water in the tub enclosure is at least as high as, or below, a predetermined level. Controller 598 is operatively attached to the depth sensor and to each of pumps 550 and 558 to render the pumps operative when the level of water in the tub enclosure is at or above the predetermined level, and inoperative when the level of water in the tub enclosure is below the predetermined level.

Controller 598 is also operatively connected to operator's control panel 600. As shown in FIG. 19B, control panel 600 includes temperature increase switch 602 and temperature decrease switch 604, both of which are operatively connected to the heater and to a temperature sensor (not shown), which is provided to measure the temperature of the water in tub enclosure 522. Switches 602 and 604 are operable by a user to adjust the temperature of the water flowing into the tub enclosure. The temperature sensor is also operatively attached to controller 598 and to display 606 of control panel 600, so that the temperature of the water in the tub enclosure at any time can be displayed to a user. Control panel 600 also includes light switch 608, spa mode control switch 610 and bathtub mode control switch 612. The light switch is operatively connected to controller 598 and to a light (not shown), which may be employed to illuminate embodiment 520. The spa mode control switch and the bathtub mode control switch are operatively connected to controller 598 and to control valve 590. These switches may be activated alternatively to operate combination 520 in the spa mode (when switch 610 is activated and control valve 590 is open) or in the bathtub mode (when switch 612 is activated and control valve 590 is closed). Control panel 600 also includes jet pump switch 614, which may be activated to operate jet flow pump 550 in either the spa mode or the bathtub mode. Controller 598 is operatively connected (by means known to those having ordinary skill in the art to which the invention relates) to control panel 600, pumps 550 and 558, heater 560, ozone generator 580 and the depth sensor. If an air control valve is provided which is adapted to be operated by a switch, the switch will also be connected to controller 598.

A user may close drain 532 and manipulate valves 542 and 544 to allow the flow of water from the supply lines into the tub enclosure. If the depth sensor of combination 520 indicates that there is water in the enclosure at or above the predetermined level, controller 598 will automatically activate the spa mode switch 610. Of course, the user may reset the system to the bathtub mode, if desired, by pressing bathtub mode switch 612.

When combination 520 is operated in the spa mode, the controller will open valve 590 and operate circulating flow pump 558. In the spa mode, the controller will also cause heater 560 to operate at a low (or default) setting, and will cause the ozone generator to operate so that water in the enclosure remains heated, filtered and sanitized. Water will flow out of tub enclosure 522 and into and out of pump 558, through line 561, heater 560 and into filter 586. Filtered water will then pass out of filter 586 through filter outlet line 592 and into the tub enclosure through jet nozzle 583. Depending on the temperature of the water in the tub enclosure, the water may be heated as it passes through heater 560, as controlled by controller 598 and as determined by user manipulation of switches 602 and 604. In the spa mode, pump 550 may also be operated to cause water to flow through water manifold 570 and various jet nozzle supply lines 568 and into the tub enclosure through jet nozzles 566. A user may also open an air control valve (if included in this embodiment) to cause air to be drawn through an air manifold (not shown) and air lines (also not shown) to be mixed with water at each nozzle so that a mixture of air and water may be injected into the tub enclosure through each of the nozzles.

If the depth sensor indicates that the water level in the enclosure is below the predetermined level, controller 598 will lock the bathtub mode control switch in the "on" setting, will close valve 590 and disable pumps 550 and 558, heater 560, and ozone generator 580 from operation. Of course, if the depth sensor subsequently indicates that the water level in the enclosure is at or above the predetermined level, controller 598 will set the spa mode control switch to the "on" setting.

If a user sets switch 608 to the bathtub mode (and the level of water in the tub enclosure is at or above the predetermined level), controller 598 will close control valve 590 and disable circulating flow pump 558, while enabling jet flow pump 550. The jet flow pump may then be operated by pressing switch 614 on control panel 600. Water will then flow out of pump 550 into water manifold 570, and from manifold 570 through various jet nozzle supply lines 568 and into the tub enclosure through jet nozzles 566. A user may also open an air control valve (if combination 520 is equipped with such component) to cause air to be drawn through an air manifold (not shown) and air lines (also not shown) to be mixed with water at each nozzle so that a mixture of air and water may be injected into the tub enclosure through each of the nozzles. When a user finishes bathing, the drain valve may be opened to drain the water from the tub enclosure.

Although this description contains many specifics, these should not be construed as limiting the scope of the invention, but as merely providing illustrations of some of the presently preferred embodiments thereof, as well as the best mode contemplated by the inventors of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. A combination bathtub and spa comprising:

(a) a tub enclosure that is adapted to contain a quantity of water;

(b) a drain having a drain valve configured to be opened to drain water from the tub enclosure or closed to retain water therein;

(c) a supply line for supplying water to the tub enclosure;

(d) a lid that is adapted to removably cover the tub enclosure;

(e) a pump having an inlet and an outlet;

(f) a suction line that provides a path for water from the tub enclosure to the inlet of the pump;

(g) a jet flow circuit comprising:

(i) a jet flow nozzle that is located in the sidewall of the tub enclosure;

(ii) a jet nozzle supply line between the outlet of the pump and the jet flow nozzle;

(h) a circulating flow circuit comprising:

(i) a circulating nozzle that is located in the sidewall of the tub enclosure;

(ii) a circulating line that is located between the outlet of the pump and the circulating nozzle;

(iii) a filter that is adapted to filter the water in the circulating flow circuit;

(iv) a heater that is adapted to be activated to heat the water that flows through the heater in the circulating flow circuit or to be deactivated so that water that flows therethrough is not heated;

(i) a control valve that is adapted to open to allow water to flow through the circulating flow circuit or to close to stop flow through the circulating flow circuit;

(j) a control switch configured to be operated by a user to switch between a spa mode in which the control valve is open and a bathtub mode in which the control valve is closed;

wherein the pump, control valve and control switch configured to be operated by a user:

(k) in a first spa mode in which the water that flows into the tub enclosure is passed through the filter and through the heater while the heater is activated; and (l) in a second spa mode in which the water that flows into the tub enclosure is passed through the filter and through the heater while the heater is deactivated; and (m) in a bathtub mode in which the water that flows into the tub enclosure is not passed through the filter.

2. The combination bathtub and spa of claim 1:

(a) which includes a depth sensor that is adapted to sense when the level of water in the tub enclosure is at least as high as, or is below, a predetermined level;

(b) which includes a controller that is operatively connected to the pump and to the depth sensor, and is adapted to render the pump operative when the level of the water in the tub enclosure is at above the predetermined level and inoperative when the level of the water in the tub enclosure is below the predetermined level.

3. The combination bathtub and spa of claim 1:

wherein the pump is adapted to selectively operate at a low flow rate and at a high flow rate;

which includes a controller that is adapted to:

(i) allow the pump to operate at either the low flow rate or the high flow rate and close the control valve when the control switch is set to the bathtub mode;

(ii) allow the pump to operate at either the low flow rate or the high flow rate and open the control valve when the control switch is set to the spa mode.

4. The combination bathtub and spa of claim 3:

(a) wherein the controller is adapted to activate and deactivate the heater;

(b) which includes a heater switch that is operatively connected to the controller, said heater switch being operable by a user to adjust the temperature of the water flowing into the tub enclosure.

5. A combination bathtub and spa comprising:

(a) a tub enclosure that is adapted to contain a quantity of water;

(b) a drain having a drain valve configured to be opened to drain water from the tub enclosure or closed to retain water therein;

(c) a supply line for supplying water to the tub enclosure;

(d) a lid that is adapted to removably cover the tub enclosure;

(e) a jet flow system comprising:

(i) a jet flow pump having an inlet and an outlet;

(ii) a suction line that provides a path for water from the tub enclosure to the inlet of the jet flow pump;

(iii) a jet nozzle that is located in the sidewall of the tub enclosure;

(iv) a jet nozzle supply line that provides a path for water from the outlet of the jet flow pump to the jet nozzle;

(f) a circulating flow system comprising:

(i) a circulating flow pump having an inlet and an outlet;

(ii) a suction line that provides a path for water from the tub enclosure to the inlet of the circulating flow pump;

(iii) a circulating flow line that provides a path for water from the outlet of the circulating flow pump to the tub enclosure;

(iv) a heater that is adapted to be activated to heat the water in the circulating flow system or to be deactivated so that the water in the circulating flow system is not heated;

(v) a filter that is adapted to filter the water in the circulating flow system;

(g) a control switch operable by a user to switch between a spa mode and a bathtub mode;

(h) a controller that is operatively connected to the jet flow pump the circulating flow pump and the control switch, said controller configured to:

(i) render the jet flow pump operative and the circulating flow pump inoperative when the control switch is set to the bathtub mode;

(ii) render the jet flow pump and the circulating flow pump operative when the control switch is set to the spa mode;

wherein;

(i) in a first spa mode, the control switch is operable to cause the controller to enable operation of both the jet flow pump and the circulating flow pump, and activate the heater, so that the water that flows into the tub enclosure is filtered and heated; and (j) in a second spa mode, the control switch is operable to cause the controller to enable operation of both the jet flow pump and the circulating flow pump, and deactivate the heater, so that in the water that flows into the tub enclosure is filtered but not heated; and (k) in a bath mode, the control switch is operable to cause the controller to enable operation of the jet flow pump and disable operation of the circulating flow pump, so that in the water that flows into the tub enclosure is not filtered.

6. The combination bathtub and spa of claim 5:

(a) which includes a depth sensor that is adapted to sense when the level of water in the tub enclosure is at least as high as, or is below, a predetermined level;

(b) wherein the controller is operatively connected to the depth sensor, the jet flow pump and the circulating flow pump and is adapted to render the jet flow pump and the circulating flow pump inoperative when the level of the water in the tub enclosure is below the predetermined level.

7. The combination bathtub and spa of claim 5 wherein the jet flow system includes a heater that is adapted to heat the water therein.

8. The combination bathtub and spa of claim 5 wherein the circulating flow system includes a sanitizer that is adapted to sanitize the water that passes therethrough.

9. The combination bathtub and spa of claim 5:

(a) wherein the controller is adapted to activate and deactivate the heater;

(b) which includes a heater switch that is operatively connected to the controller, said heater switch being operable by a user to adjust the temperature of the water flowing into the tub enclosure.

* * * * *